US009570020B2

(12) United States Patent
Yoo et al.

(10) Patent No.: US 9,570,020 B2
(45) Date of Patent: Feb. 14, 2017

(54) DISPLAY DEVICE HAVING SUBPIXELS OF FOUR COLORS IN EACH PIXEL

(71) Applicant: LG Display Co., Ltd., Seoul (KR)

(72) Inventors: Dukkeun Yoo, Seoul (KR); Wonho Lee, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/566,973

(22) Filed: Dec. 11, 2014

(65) Prior Publication Data

US 2015/0187293 A1 Jul. 2, 2015

(30) Foreign Application Priority Data

Dec. 31, 2013 (KR) ..... 10-2013-0168562

(51) Int. Cl.
*G09G 5/02* (2006.01)
*G09G 3/36* (2006.01)

(52) U.S. Cl.
CPC ..... *G09G 3/3607* (2013.01); *G09G 3/3614* (2013.01); *G09G 2300/0426* (2013.01); *G09G 2300/0439* (2013.01); *G09G 2300/0452* (2013.01); *G09G 2310/0297* (2013.01); *G09G 2320/0242* (2013.01); *G09G 2320/0247* (2013.01)

(58) Field of Classification Search
CPC ..... G09G 3/36; G09G 3/30; G09G 5/10; G09G 5/02; G09G 5/00; H04N 1/405
See application file for complete search history.

(56) References Cited

U.S. PATENT DOCUMENTS

| | | | |
|---|---|---|---|
| 7,787,702 | B2 | 8/2010 | Brown Elliott et al. |
| 7,898,518 | B2 | 3/2011 | Hong et al. |
| 7,948,465 | B2 | 5/2011 | Cho et al. |
| 8,330,699 | B2 | 12/2012 | Hong et al. |
| 8,525,769 | B2 | 9/2013 | Miyashita |

(Continued)

FOREIGN PATENT DOCUMENTS

| | | | |
|---|---|---|---|
| CN | 101176108 | A | 5/2008 |
| CN | 101286311 | A | 10/2008 |

(Continued)

OTHER PUBLICATIONS

Extended European Search Report dated Jul. 14, 2014, for EP Application No. 14169208.7.

(Continued)

*Primary Examiner* — Pegeman Karimi
(74) *Attorney, Agent, or Firm* — Morgan, Lewis & Bockius LLP

(57) ABSTRACT

A disclosed display device includes a display panel including a plurality of data lines and a plurality of gate lines intersecting the data lines, and a pixel array comprising a plurality of pixels arranged in a matrix form, each pixel being divided into a subpixel having a first color, a subpixel having a second color, a subpixel having a third color, and a subpixel having a fourth color. Two adjacent subpixels in a horizontal line of the pixel array share one of the data lines. For at least one of the first, second, third, and fourth colors, subpixels having a same color are arranged in a hexagonal shape on four adjacent horizontal lines or a diamond shape on three adjacent horizontal lines of the pixel array.

26 Claims, 13 Drawing Sheets

(56) References Cited

U.S. PATENT DOCUMENTS

| | | | | |
|---|---|---|---|---|
| 9,024,979 | B2 | 5/2015 | Lee et al. | |
| 9,164,310 | B2 | 10/2015 | Kim et al. | |
| 2006/0256053 | A1 | 11/2006 | Baek | |
| 2006/0284805 | A1 | 12/2006 | Baek | |
| 2007/0236422 | A1 | 10/2007 | Park et al. | |
| 2008/0074369 | A1 | 3/2008 | Hsu | |
| 2008/0284758 | A1 | 11/2008 | Lee et al. | |
| 2009/0058873 | A1* | 3/2009 | Brown Elliott | G06T 5/009 345/589 |
| 2009/0189881 | A1 | 7/2009 | Ooishi et al. | |
| 2010/0328360 | A1 | 12/2010 | Miyashita | |
| 2011/0285950 | A1 | 11/2011 | Su et al. | |
| 2012/0098871 | A1 | 4/2012 | Park et al. | |
| 2012/0105494 | A1* | 5/2012 | Lee | G09G 3/3614 345/690 |
| 2012/0293536 | A1 | 11/2012 | Yonemaru et al. | |
| 2012/0305947 | A1 | 12/2012 | Lee | |
| 2013/0050282 | A1* | 2/2013 | Kim | G09G 3/3413 345/690 |
| 2013/0088509 | A1* | 4/2013 | Yoshimoto | G09G 3/2003 345/600 |
| 2014/0043306 | A1* | 2/2014 | Min | G09G 3/3685 345/204 |
| 2014/0118325 | A1* | 5/2014 | Im | G09G 3/3614 345/212 |
| 2016/0048053 | A1 | 2/2016 | Kim et al. | |

FOREIGN PATENT DOCUMENTS

| | | | |
|---|---|---|---|
| CN | 101494020 | A | 7/2009 |
| CN | 101582244 | A | 11/2009 |
| CN | 101937142 | A | 1/2011 |
| CN | 102243827 | A | 11/2011 |
| CN | 102456334 | A | 5/2012 |
| CN | 102636894 | A | 8/2012 |
| CN | 103185996 | A | 7/2013 |
| EP | 1 845 513 | A2 | 10/2007 |
| JP | 2000330523 | A | 11/2000 |
| JP | 2008249895 | A | 10/2008 |
| KR | 10-2006-0117025 | A | 11/2006 |
| KR | 10-2006-0133194 | A | 12/2006 |
| KR | 10-2007-0011830 | A | 1/2007 |
| KR | 10-2007-0080140 | A | 8/2007 |

OTHER PUBLICATIONS

Japanese Office Action—First Office Action for Japanese Patent Application No. 2014-114599—Issued on May 19, 2015.

Chinese Office Action dated Oct. 24, 2016 for the related Chinese patent application No. 201410283673.2 and English translation of same.

* cited by examiner

DISPLAY DEVICE HAVING SUBPIXELS OF FOUR COLORS IN EACH PIXEL

This application claims the benefit of Korean Patent Application No. 10-2013-0168562 filed on Dec. 31, 2013, the entire contents of which is incorporated herein by reference for all purposes as if fully set forth herein.

BACKGROUND OF THE INVENTION

Field of the Invention

The present invention relates to a display device, and more particularly to a display device in which each pixel is divided into a red subpixel, a green subpixel, a blue subpixel, and a white subpixel.

Discussion of the Related Art

Various flat panel displays, such as a liquid crystal display (LCD), a plasma display panel (PDP), an organic light emitting display (OLED), and an electrophoresis display (EPD), have been developed. The liquid crystal display displays an image by controlling an electric field applied to liquid crystal molecules based on a data voltage. An active matrix liquid crystal display includes a thin film transistor (TFT) in each pixel. The pixels of the liquid crystal display may be divided into red (R) subpixels, green (G) subpixels, blue (B) subpixels, and white (W) subpixels, so as to display various colors and to increase luminance. In the following description, the display device in which the pixels are divided into R, G, B, and W subpixels is referred to as an RGBW type display device.

The liquid crystal display includes, among other things, a liquid crystal display panel, a backlight unit providing light to the liquid crystal display panel, source driver integrated circuits (ICs) for supplying a data voltage to data lines of the liquid crystal display panel, gate driver ICs for supplying a gate pulse (or scan pulse) to gate lines (or scan lines) of the liquid crystal display panel, a control circuit for controlling the source driver ICs and the gate driver ICs, and a light source driving circuit for driving light sources of the backlight unit.

The liquid crystal display is driven through an inversion scheme, which sets polarities of the data voltages charged to adjacent subpixels to be opposite to each other and periodically inverts the polarities of the data voltages, so as to reduce image sticking caused by direct current and to prevent degradation of the liquid crystals. Most of the liquid crystal displays employ a horizontal and vertical 1-dot inversion scheme or a horizontal 1-dot and vertical 2-dot inversion scheme. A 1-dot refers to one subpixel.

A charge amount of subpixels of each color may vary depending on a relationship between data of an input image and a polarity pattern of the pixels. In this instance, a line noise of a longitudinal line shape and color distortion may appear in an image displayed on a pixel array due to the color arrangement of the subpixels.

SUMMARY OF THE INVENTION

Accordingly, the present invention is directed to a display device that substantially obviates one or more of the problems due to limitations and disadvantages of the related art.

An object of the present invention is to provide a liquid crystal display, in which each pixel of an RGBW type display device is divided into R, G, B, and W subpixels, capable of improving the display quality.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a display device includes a display panel including a plurality of data lines and a plurality of gate lines intersecting the data lines, and a pixel array comprising a plurality of pixels arranged in a matrix form, each pixel being divided into a subpixel having a first color, a subpixel having a second color, a subpixel having a third color, and a subpixel having a fourth color, wherein two adjacent subpixels in a horizontal line of the pixel array share one of the data lines; a data driver configured to supply data voltages to the data lines; a gate driver configured to sequentially supply a gate pulse to the gate lines; and a timing controller configured to transmit data of an input image to the data driver and to control the data driver and the gate driver, wherein, for at least one of the first, second, third, and fourth colors, subpixels having a same color are arranged in a hexagonal shape on four adjacent horizontal lines of the pixel array.

In another aspect of the invention, a display device includes a display panel including a plurality of data lines and a plurality of gate lines intersecting the data lines, and a pixel array comprising a plurality of pixels arranged in a matrix form, each pixel being divided into a subpixel having a first color, a subpixel having a second color, a subpixel having a third color, and a subpixel having a fourth color, wherein two adjacent subpixels in a horizontal line of the pixel array share one of the data lines; a data driver configured to supply data voltages to the data lines; a gate driver configured to sequentially supply a gate pulse to the gate lines; and a timing controller configured to transmit data of an input image to the data driver and to control the data driver and the gate driver, wherein, for at least one of the first, second, third, and fourth colors, subpixels having a same color are arranged in a diamond shape on three adjacent horizontal lines of the pixel array.

In yet another aspect of the invention, a display device includes a display panel including a plurality of data lines and a plurality of gate lines intersecting the data lines, and a pixel array comprising a plurality of pixels arranged in a matrix form, each pixel being divided into a subpixel having a first color, a subpixel having a second color, a subpixel having a third color, and a subpixel having a fourth color; a data driver configured to supply data voltages to the data lines; a gate driver configured to sequentially supply a gate pulse to the gate lines; and a timing controller configured to transmit data of an input image to the data driver and to control the data driver and the gate driver, wherein the four subpixels of each of the pixels are disposed in two adjacent horizontal lines of the pixel array, either with three of the four subpixels disposed in one of the two adjacent horizontal lines and the other subpixel in the other of the two adjacent horizontal lines, or with two of the subpixels disposed in each of the two adjacent horizontal lines.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the present invention, examples of which are illustrated in the accompanying drawings. Wherever possible, the same reference numbers will be used throughout the drawings to refer to the same or like parts.

A display device according to an example embodiment of the invention may be implemented as a flat panel display capable of representing colors, such as a liquid crystal display (LCD), a plasma display panel (PDP), and an organic light emitting display (OLED). In the following description, the embodiments of the invention will be described using the liquid crystal display as an example of the flat panel display, but they are also applicable to other types of flat panel displays. For example, an arrangement of red (R), green (G), blue (B), and white (W) subpixels according to the embodiments of the invention may be applied to the organic light emitting display.

Figure 1:
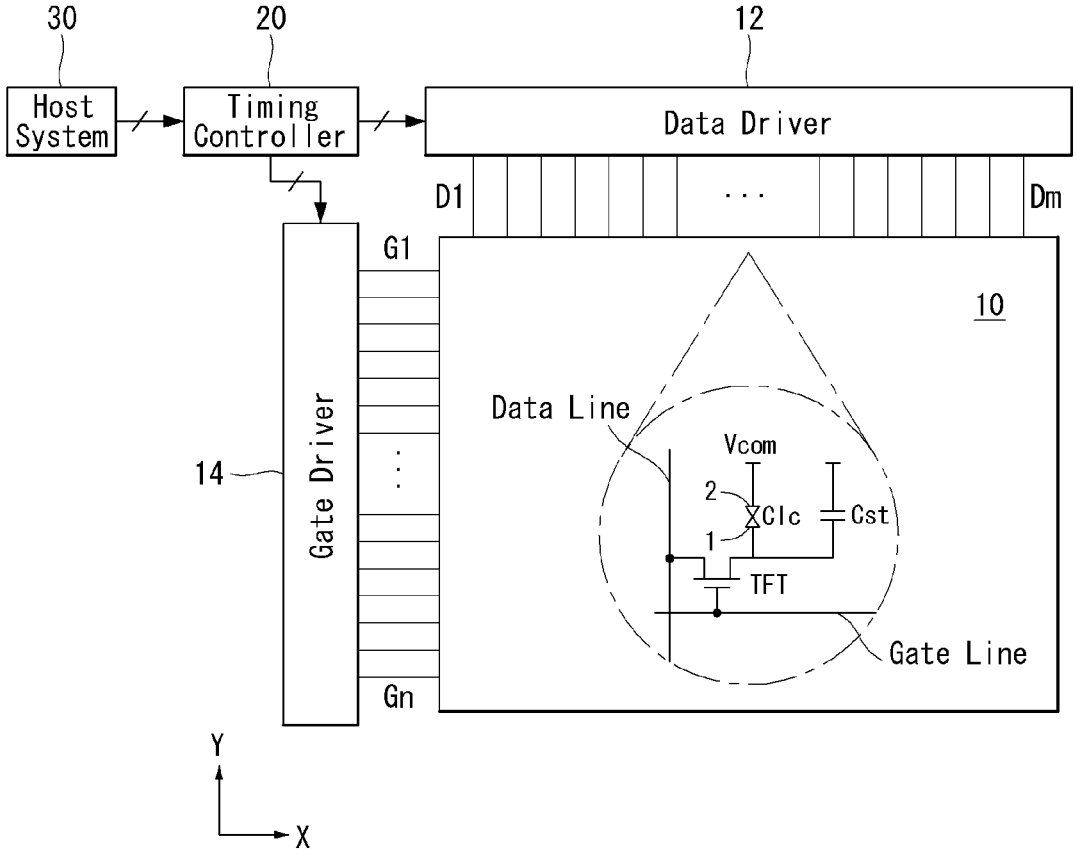
FIG. 1 is a block diagram of a liquid crystal display according to an example embodiment of the invention.

As shown in FIG. 1, a display device according to an example embodiment of the invention includes a display panel 10 including a pixel array and a display panel driving circuit for writing data of an input image on the display panel 10. A backlight unit (not shown) uniformly providing light to the display panel 10 may be disposed under the display panel 10.

The display panel 10 includes an upper substrate and a lower substrate, which are positioned opposite each other with a liquid crystal layer interposed therebetween. The display panel 10 also has a plurality of data lines and a plurality of gate lines intersecting the data lines, and a pixel array. The pixel array includes pixels arranged in a matrix form based on a crossing structure of data lines D1 to Dm and gate lines G1 to Gn, each pixel being divided into a first subpixel having a first color, a second subpixel having a second color, a third subpixel having a third color, and a fourth subpixel having a fourth color, wherein two adjacent subpixels in a horizontal line of the pixel array share one of the plurality of data lines The pixel array including the data lines D1 to Dm, the gate lines G1 to Gn intersecting the data lines D1 to Dm is formed on the lower substrate of the display panel 10. The pixel array also includes thin film transistors (TFTs), each connected to one of the gate lines G1 to Gn and one of the data lines D1 to Dm, pixel electrodes 1 connected to the TFTs, and storage capacitors Cst connected to the pixel electrodes 1. Each pixel adjusts a transmitted amount of light by driving liquid crystal molecules with a voltage difference between the pixel electrode 1 charged to a data voltage through the TFT and a common voltage Vcom supplied to a common electrode 2, thereby displaying an image of video data. Each pixel is divided into red (R), green (G), blue (B), and white (W) subpixels. The RGBW subpixels may be arranged based on any of the example configurations shown in FIGS. 2A, 2B, 4A, 4B, and 6 to 11.

A color filter array including black matrixes and color filters is formed on the upper substrate of the display panel 10. In a vertical electric field driving mode such as a twisted nematic (TN) mode or a vertical alignment (VA) mode, the common electrodes 2 are formed on the upper substrate. In a horizontal electric field driving mode such as an in-plane switching (IPS) mode or a fringe field switching (FFS) mode, the common electrodes 2 are formed on the lower substrate along with the pixel electrodes 1. Polarizing plates (not shown) are respectively attached to the upper substrate and the lower substrate of the display panel 10. Alignment layers (not shown) for setting a pre-tilt angle of liquid crystal molecules are respectively formed on the upper and lower glass substrates of the display panel 10.

The liquid crystal display according to the example embodiment of the invention may be implemented as any type of liquid crystal display, including a transmissive liquid crystal display, a transflective liquid crystal display, and a reflective liquid crystal display. The transmissive liquid crystal display and the transflective liquid crystal display require a backlight unit. The backlight unit may be implemented as a direct type backlight unit or an edge type backlight unit.

The display panel driving circuit writes data on the pixels. The display panel driving circuit includes a data driver 12, a gate driver 14, and a timing controller 20.

The data driver 12 includes a plurality of source driver integrated circuits (ICs). Output channels of the source driver ICs are respectively connected to the data lines D1 to Dm of the pixel array. The total number of output channels of the source driver ICs is reduced to about ½ of the total number of data lines D1 to Dm due to a structure of the example pixel arrays shown in FIGS. 2A to 11. Thus, the manufacturing cost of the display device according to the embodiment of the invention may be reduced.

The data driver 12 receives data of the input image from the timing controller 20. Digital video data transmitted to the data driver 12 includes red (R) data, green (G) data, blue (B) data, and white (W) data. The data driver 12 converts the RGBW digital video data of the input image into positive and negative gamma compensation voltages under the control of the timing controller 20 and supplies positive and negative data voltages to the data lines D1 to Dm.

The gate driver 14 sequentially supplies a gate pulse to the gate lines G1 to Gn under the control of the timing controller 20. The gate pulse output from the gate driver 14 is synchronized with positive and negative video data voltages supplied by the data driver 12, which voltages will be charged to the pixels.

The timing controller 20 converts the RGB data of the input image received from a host system 30 into RGBW data and transmits the RGBW data to the data driver 12. An interface for data transmission between the timing controller 20 and the source driver ICs of the data driver 12 may use, for example, a mini low voltage differential signaling (LVDS) interface or an embedded panel interface (EPI). The EPI may use any of the interface technologies disclosed in U.S. Pat. No. 8,330,699, U.S. Pat. No. 7,898,518, U.S. Pat. No. 7,948,465, which are hereby incorporated by reference in their entirety.

The timing controller 20 receives timing signals synchronized with the data of the input image from the host system 30. The timing signals may include such signals as a vertical sync signal Vsync, a horizontal sync signal Hsync, a data enable signal DE, and a dot clock DCLK. The timing controller 20 controls operation timings of the data driver 12 and the gate driver 14 based on the timing signals Vsync, Hsync, DE, and DCLK received along with pixel data of the input image. The timing controller 20 may transmit polarity information of data for controlling the polarities of the pixel array to each of the source driver ICs of the data driver 12. The mini LVDS interface is an interface technology for transmitting a polarity control signal through a separate control line. The EPI is an interface technology which encodes polarity control information to a control data packet transmitted between a clock training pattern for clock and data recovery (CDR) and an RGBW data packet, and transmits the polarity control information to each of the source driver ICs of the data driver 12.

The timing controller 20 may convert the RGB data of the input image into the RGBW data using a white gain calculation algorithm. Any known white gain calculation algorithm may be used. For example, the embodiment of the invention may use any of the white gain calculation algorithms disclosed in Korean Patent Publication Nos. 10-2006-0117025, 10-2006-0133194, 10-2007-0011830, and 10-2007-0080140, which are hereby incorporated by reference in their entirety.

The host system 30 may be implemented as a television system, a set-top box, a navigation system, a DVD player, a Blu-ray player, a personal computer (PC), a home theater system, a phone system, or any other system capable of generating an image data.

The example embodiments of the invention configure the structure of the pixel array into a double rate driving (DRD) type pixel array, in which two horizontally adjacent subpixels share one data line with each other as shown in FIGS. 2A, 2B, 4A, 4B, and 6 to 9, so as to reduce the number of source driver ICs of the data driver 12. The source driver ICs used in the DRD type pixel array may double the frequency of the data voltage. Thus, the DRD type pixel array may reduce the number of source driver ICs by one half.

The example embodiments of the invention provide that the pixels of the pixel array are arranged based on the configurations shown in FIGS. 2A, 2B, 4A, 4B, and 6 to 11, so as to uniformize data charge characteristics of the RGBW subpixels based on the colors of the subpixels and prevent color distortion. The example embodiments of the invention also provide that a polarity pattern of the pixel array is implemented as shown in FIGS. 2A, 2B, 4A, 4B, and 6 to 9, so as to uniformize polarities of the pixel array based on the colors of the subpixels. In the following example embodiments, red, green, blue, and white are referred to as a first color R, a second color G, a third color B, and a fourth color W, as an example. However, the embodiment of the invention is not limited thereto.

The example embodiment of the invention controls the polarity pattern of the pixel array in a dot inversion scheme inverting the polarity between the adjacent subpixels along vertical and horizontal directions. The polarity pattern of the pixel array is determined depending on the polarity of the data voltage output from each of the source driver ICs of the data driver 12 and the structure of the pixel array.

A horizontal polarity pattern of the pixel array is determined depending on the polarities of the data voltages which are simultaneously output through the output channels of the source driver ICs. For example, when "+" and "−" respectively indicate the positive polarity and the negative polarity, the horizontal polarity pattern, in which the polarities of the data voltages simultaneously output through the output channels of the source driver ICs are represented by "+−+−" or "−+−+" from left to right, is referred to as a horizontal 1-dot inversion scheme. As another example, the horizontal polarity pattern, in which the polarities of the data voltages are represented by "++−−" or "−−++" from left to right, is referred to as a horizontal 2-dot inversion scheme.

A vertical polarity pattern of the pixel array is determined depending on sequential changes in the polarities of the data voltages, which are output through the output channels of the source driver ICs, as time passes. For example, the vertical polarity pattern, in which the polarities of the data voltages sequentially output through the output channels of the source driver ICs are represented by "+−+−" or "−+−+" as time passes, is referred to as a vertical 1-dot inversion scheme. As another example, the vertical polarity pattern, in which the polarities of the data voltages sequentially output through the output channels of the source driver ICs are represented by "++−−" or "−−++" as time passes, is referred to as a vertical 2-dot inversion scheme.

Figure 2A:
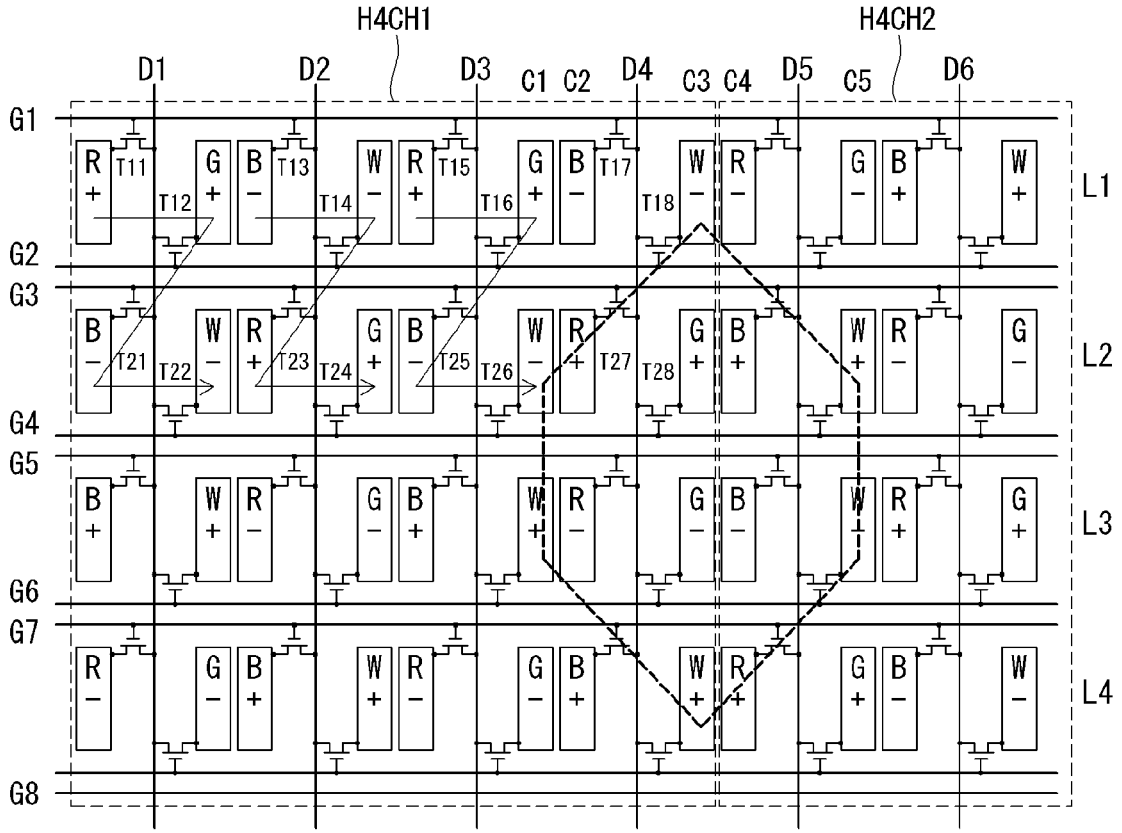
FIGS. 2A and 2B are equivalent circuit diagrams showing a portion of a pixel array according to a first example embodiment of the invention.
Figure 2B:
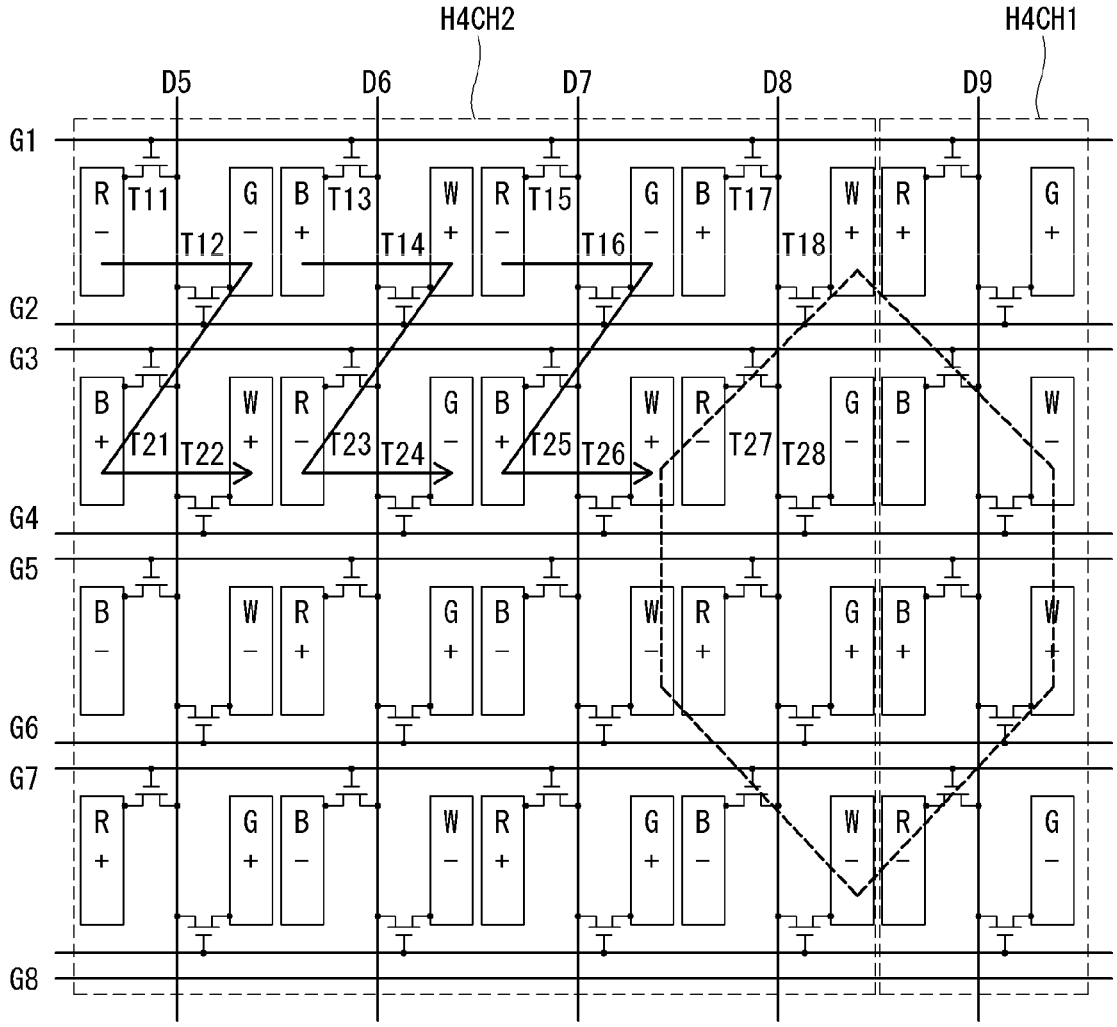
Figure 3:
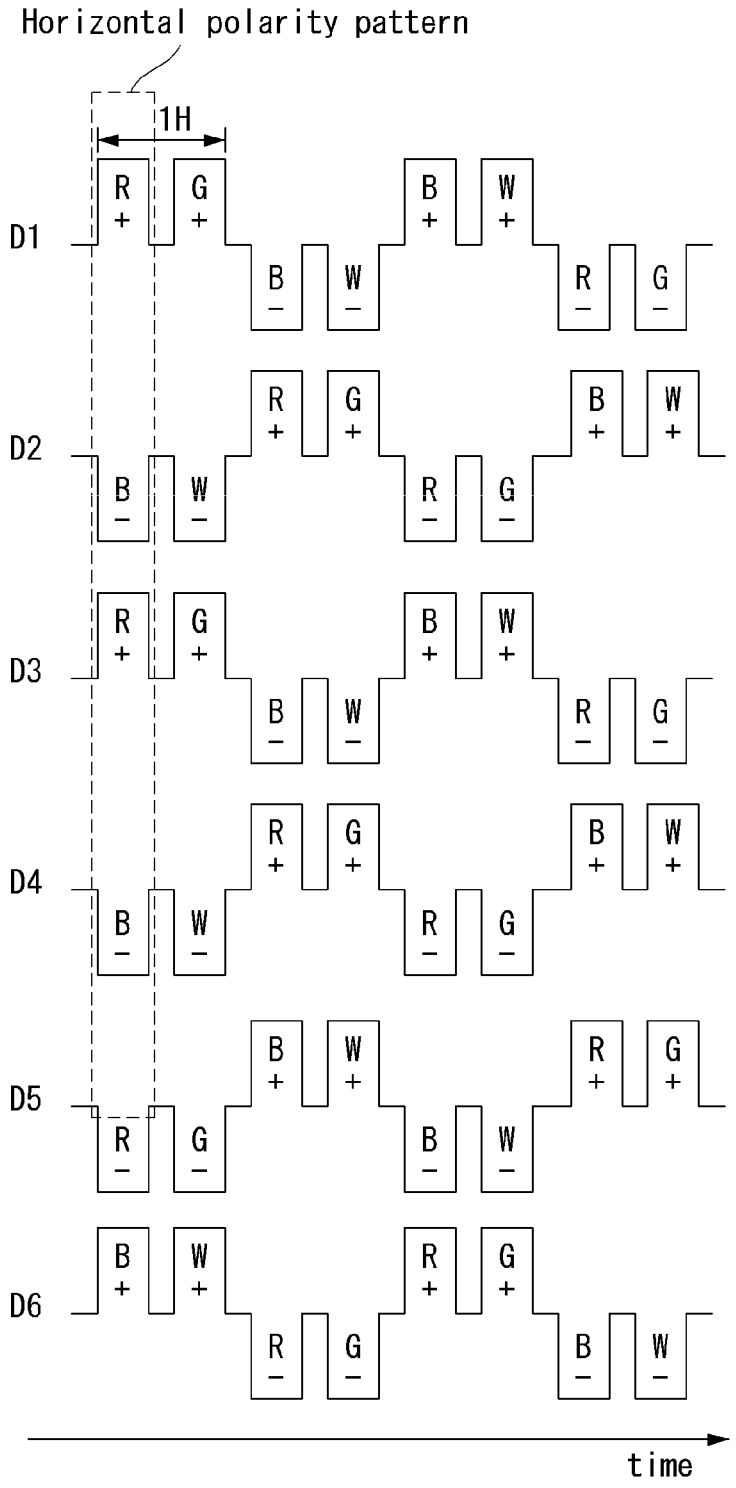
FIG. 3 is a waveform diagram showing a data voltage applied to the pixel array shown in FIGS. 2A and 2B.

FIGS. 2A and 2B are an equivalent circuit diagram showing a portion of a pixel array according to a first embodiment of the invention. FIG. 3 is a waveform diagram showing a data voltage applied to the pixel array shown in FIGS. 2A and 2B.

As shown in FIGS. 2A, 2B, and 3, R subpixels, G subpixels, B subpixels, and W subpixels on the first to fourth lines L1 to L4 of a pixel array are individually arranged in a hexagonal shape (or a honeycomb shape) as indicated by the dotted line. The W subpixels may increase the luminance of the input image and may reduce power consumption of the display device. Namely, the example embodiment of the invention arranges subpixels of the same color on four adjacent horizontal lines of the pixel array in the hexagonal shape as indicated by the dotted line. One hexagon has the size disposed on five vertical lines C1 to C5 and four horizontal lines L1 to L4.

The example embodiment of the invention arranges the TFTs for connecting the pixel electrode 1 of the subpixels to the data lines in a zigzag shape along the data lines, so as to implement the DRD type pixel array. The two adjacent subpixels positioned on the left and right sides of one data line, respectively, are sequentially charged to the data voltage from the one data line and share the one data line with each other. The output channels of the source driver ICs are respectively connected to the data lines D1 to Dm.

The source driver ICs invert a horizontal polarity pattern in a cycle of four output channels. For example, during the N-th frame period (where N is a positive integer), a horizontal polarity pattern of the data voltages output through the (8i+1)-th to (8i+4)-th output channels of the source driver ICs is represented by "+−+−", and a horizontal polarity pattern of the data voltages output through the (8i+5)-th to (8i+8)-th output channels of the source driver ICs is represented by "−+−+", where 'i' is zero and a positive integer. Each of the source driver ICs may invert polarities of the output channels in each frame period. In this instance, during the (N+1)-th frame period, a horizontal polarity pattern of the data voltages output through the (8i+1)-th to (8i+4)-th output channels of the source driver ICs is represented by "−+−+", and a horizontal polarity pattern of the data voltages output through the (8i+5)-th to (8i+8)-th output channels of the source driver ICs is represented by "+−+−". In FIGS. 2A and 2B, 'H4CH1' denotes a first pixel group connected to the (8i+1)-th to (8i+4)-th output channels of the source driver ICs, and 'H4CH2' denotes a second pixel group connected to the (8i+5)-th to (8i+8)-th output channels of the source driver ICs. A polarity pattern of the second pixel group H4CH2 is an inverse polarity pattern of a polarity pattern of the first pixel group H4CH1.

In each source driver IC, the data voltages of the same polarity, which will be charged to two adjacent subpixels positioned on the left and right sides of one data line, are successively output in one horizontal period 1H. The data voltages of the same polarity are supplied to the two adjacent subpixels through the one data line in one horizontal period 1H. Thus, each of the source driver ICs of the data driver 12 inverts the polarities of the data voltages in a horizontal 1-dot and vertical 2-dot inversion scheme.

When the source driver ICs supply the data voltages, of which the polarities are inverted in the horizontal 1-dot and vertical 2-dot inversion scheme, to the data lines, a polarity pattern of the pixel array follows the horizontal 2-dot and vertical 2-dot inversion scheme due to the structure of the DRD type pixel array.

In the (4i+1)-th and (4i+4)-th horizontal lines of the pixel array, the (4i+1)-th subpixels have the first color R; the (4i+2)-th subpixels have the second color G; the (4i+3)-th subpixels have the third color B; and the (4i+4)-th subpixels have the fourth color W.

In the (4i+2)-th and (4i+3)-th horizontal lines of the pixel array, the (4i+1)-th subpixels have the third color B; the (4i+2)-th subpixels have the fourth color W; the (4i+3)-th subpixels have the first color R; and the (4i+4)-th subpixels have the second color G.

The connection between the subpixels and the data lines shown in FIGS. 2A and 2B is described below in terms of the corresponding TFTs. In the following description, a +R (or +G, +B, or +W) data voltage represents a positive R (or G, B, or W) data voltage, and a −R (or −G, −B, or −W) data voltage represents a negative R (or G, B, and W) data voltage. In FIGS. 2A and 2B, T11 to T18 respectively denote eight TFTs disposed on the (4i+1)-th and (4i+4)-th horizontal lines of the pixel array from left to right in order. Further, T21 to T28 respectively denote eight TFTs disposed on the (4i+2)-th and (4i+3)-th horizontal lines of the pixel array from left to right in order.

During the N-th frame period, the source driver ICs output positive data voltages to the data lines D1, D3, D6, and D8 through the (8i+1)-th, (8i+3)-th, (8i+6)-th, and (8i+8)-th output channels, respectively, and output negative data voltages to the data lines D2, D4, D5, and D7 through the (8i+2)-th, (8i+4)-th, (8i+5)-th, and (8i+7)-th output channels, respectively. The data voltages output through all of the output channels of the source driver ICs are sequentially charged first to the left subpixel (i.e., the subpixel disposed to the left of the data line) and then to the right subpixel (i.e., the subpixel disposed to the right of the data line) on all of the horizontal lines of the pixel array as indicated by the arrow in FIGS. 2A and 2B. The gate driver 14 sequentially outputs the gate pulse synchronized with the data voltage.

In the (4i+1)-th horizontal line of the pixel array, the first subpixel and the second subpixel are positioned adjacent to each other on the left and right sides of the first data line D1, respectively, and are sequentially charged to the positive data voltage from the first data line D1. The first TFT T11 supplies the +R data voltage supplied through the first data line D1 to the first subpixel in response to the first gate pulse from the first gate line G1. The second TFT T12 supplies the +G data voltage supplied through the first data line D1 to the second subpixel in response to the second gate pulse from the second gate line G2. The first subpixel is charged to the +R data voltage during the first half of the first horizontal period. Subsequently, the second subpixel is charged to the +G data voltage during the second half of the first horizontal period. A gate electrode of the first TFT T11 is connected to the first gate line G1. A drain electrode of the first TFT T11 is connected to the first data line D1, and a source electrode of the first TFT T11 is connected to the pixel electrode of the first subpixel. A gate electrode of the second TFT T12 is connected to the second gate line G2. A drain electrode of the second TFT T12 is connected to the first data line D1, and a source electrode of the second TFT T12 is connected to the pixel electrode of the second subpixel.

In the (4i+1)-th horizontal line of the pixel array, the third subpixel and the fourth subpixel are positioned adjacent to each other on the left and right sides of the second data line D2, respectively, and are sequentially charged to the negative data voltage from the second data line D2. The third TFT T13 supplies the −B data voltage supplied through the second data line D2 to the third subpixel in response to the first gate pulse from the first gate line G1. The fourth TFT T14 supplies the −W data voltage supplied through the second data line D2 to the fourth subpixel in response to the second gate pulse from the second gate line G2. The third subpixel is charged to the −B data voltage during the first half of the first horizontal period. Subsequently, the fourth subpixel is charged to the −W data voltage during the second half of the first horizontal period. A gate electrode of the third TFT T13 is connected to the first gate line G1. A drain electrode of the third TFT T13 is connected to the second data line D2, and a source electrode of the third TFT T13 is connected to the pixel electrode of the third subpixel. A gate electrode of the fourth TFT T14 is connected to the second gate line G2. A drain electrode of the fourth TFT T14 is connected to the second data line D2, and a source electrode of the fourth TFT T14 is connected to the pixel electrode of the fourth subpixel.

In the (4i+1)-th horizontal line of the pixel array, the fifth subpixel and the sixth subpixel are positioned adjacent to each other on the left and right sides of the third data line D3, respectively, and are sequentially charged to the positive data voltage from the third data line D3. The fifth and sixth subpixels are connected to the third data line D3 through the fifth and sixth TFTs T15 and T16, respectively. The fifth TFT T15 supplies the +R data voltage supplied through the third data line D3 to the fifth subpixel in response to the first gate pulse from the first gate line G1. The sixth TFT T16 supplies the +G data voltage supplied through the third data line D3 to the sixth subpixel in response to the second gate pulse from the second gate line G2. The fifth subpixel is charged to the +R data voltage during the first half of the first horizontal period. Subsequently, the sixth subpixel is charged to the +G data voltage during the second half of the first horizontal period.

In the (4i+1)-th horizontal line of the pixel array, the seventh subpixel and the eighth subpixel are positioned adjacent to each other on the left and right sides of the fourth data line D4, respectively, and are sequentially charged to the negative data voltage from the fourth data line D4. The seventh and eighth subpixels are connected to the fourth data line D4 through seventh and eighth TFTs T17 and T18, respectively. The seventh TFT T17 supplies the −B data voltage supplied through the fourth data line D4 to the seventh subpixel in response to the first gate pulse from the first gate line G1. The eighth TFT T18 supplies the −W data voltage supplied through the fourth data line D4 to the eighth subpixel in response to the second gate pulse from the second gate line G2. The seventh subpixel is charged to the −B data voltage during the first half of the first horizontal period. Subsequently, the eighth subpixel is charged to the −W data voltage during the second half of the first horizontal period.

In the (4i+2)-th horizontal line of the pixel array, the first subpixel and the second subpixel are positioned adjacent to each other on the left and right sides of the first data line D1, respectively, and are sequentially charged to the negative data voltage from the first data line D1. The first TFT T21 supplies the −B data voltage supplied through the first data line D1 to the first subpixel in response to a third gate pulse from a third gate line G3. The second TFT T22 supplies the −W data voltage supplied through the first data line D1 to the second subpixel in response to a fourth gate pulse from a fourth gate line G4. The first subpixel is charged to the −B data voltage during the first half of the second horizontal period. Subsequently, the second subpixel is charged to the −W data voltage during the second half of the second horizontal period. A gate electrode of the first TFT T21 is connected to the third gate line G3. A drain electrode of the first TFT T21 is connected to the first data line D1, and a source electrode of the first TFT T21 is connected to the pixel electrode of the first subpixel. A gate electrode of the second TFT T22 is connected to the fourth gate line G4. A drain electrode of the second TFT T22 is connected to the first data line D1, and a source electrode of the second TFT T22 is connected to the pixel electrode of the second subpixel.

In the (4i+2)-th horizontal line of the pixel array, the third subpixel and the fourth subpixel are positioned adjacent to each other on the left and right sides of the second data line D2, respectively, and are sequentially charged to the positive data voltage from the second data line D2. The third TFT T23 supplies the +R data voltage supplied through the second data line D2 to the third subpixel in response to the third gate pulse from the third gate line G3. The fourth TFT T24 supplies the +G data voltage supplied through the second data line D2 to the fourth subpixel in response to the fourth gate pulse from the fourth gate line G4. The third subpixel is charged to the +R data voltage during the first half of the second horizontal period. Subsequently, the fourth subpixel is charged to the +G data voltage during the second half of the second horizontal period. A gate electrode of the third TFT T23 is connected to the third gate line G3. A drain electrode of the third TFT T23 is connected to the second data line D2, and a source electrode of the third TFT T23 is connected to the pixel electrode of the third subpixel. A gate electrode of the fourth TFT T24 is connected to the fourth gate line G4. A drain electrode of the fourth TFT T24 is connected to the second data line D2, and a source electrode of the fourth TFT T24 is connected to the pixel electrode of the fourth subpixel.

In the (4i+2)-th horizontal line of the pixel array, the fifth subpixel and the sixth subpixel are positioned adjacent to each other on the left and right sides of the third data line D3, respectively, and are sequentially charged to the negative data voltage from the third data line D3. The fifth and sixth subpixels are connected to the third data line D3 through fifth and sixth TFTs T25 and T26, respectively. The fifth TFT T25 supplies the −B data voltage supplied through the third data line D3 to the fifth subpixel in response to the third gate pulse from the third gate line G3. The sixth TFT T26 supplies the −W data voltage supplied through the third data line D3 to the sixth subpixel in response to the fourth gate pulse from the fourth gate line G4. The fifth subpixel is charged to the −B data voltage during the first half of the second horizontal period. Subsequently, the sixth subpixel is charged to the −W data voltage during the second half of the second horizontal period.

In the (4i+2)-th horizontal line of the pixel array, the seventh subpixel and the eighth subpixel are positioned adjacent to each other on the left and right sides of the fourth data line D4, respectively, and are sequentially charged to the positive data voltage from the fourth data line D4. The seventh and eighth subpixels are connected to the fourth data line D4 through seventh and eighth TFTs T27 and T28, respectively. The seventh TFT T27 supplies the +R data voltage supplied through the fourth data line D4 to the seventh subpixel in response to the third gate pulse from the third gate line G3. The eighth TFT T28 supplies the +G data voltage supplied through the fourth data line D4 to the eighth subpixel in response to the fourth gate pulse from the fourth gate line G4. The seventh subpixel is charged to the +R data voltage during the first half of the second horizontal period. Subsequently, the eighth subpixel is charged to the +G data voltage during the second half of the second horizontal period.

In the (4i+3)-th horizontal line of the pixel array, the first TFT supplies the +B data voltage supplied through the first data line D1 to the first subpixel in response to the fifth gate pulse from the fifth gate line G5. The second TFT supplies the +W data voltage supplied through the first data line D1 to the second subpixel in response to the sixth gate pulse from the sixth gate line G6. The first subpixel is charged to the +B data voltage during the first half of the third horizontal period. Subsequently, the second subpixel is charged to the +W data voltage during the second half of the third horizontal period. The third TFT supplies the −R data voltage supplied through the second data line D2 to the third subpixel in response to the fifth gate pulse. The fourth TFT supplies the −G data voltage supplied through the second data line D2 to the fourth subpixel in response to the sixth gate pulse. The third subpixel is charged to the −R data voltage during the first half of the third horizontal period. Subsequently, the fourth subpixel is charged to the −G data voltage during the second half of the third horizontal period. The fifth TFT supplies the +B data voltage supplied through the third data line D3 to the fifth subpixel in response to the fifth gate pulse. The sixth TFT supplies the +W data voltage supplied through the third data line D3 to the sixth subpixel in response to the sixth gate pulse. The fifth subpixel is charged to the +B data voltage during the first half of the third horizontal period. Subsequently, the sixth subpixel is charged to the +W data voltage during the second half of the third horizontal period. The seventh TFT supplies the −R data voltage supplied through the fourth data line D4 to the seventh subpixel in response to the fifth gate pulse. The eighth TFT supplies the −G data voltage supplied through the fourth data line D4 to the eighth subpixel in response to the sixth gate pulse. The seventh subpixel is charged to the −R data voltage during the first half of the third horizontal period. Subsequently, the eighth subpixel is charged to the −G data voltage during the second half of the third horizontal period.

In the (4i+4)-th horizontal line of the pixel array, the first TFT supplies the −R data voltage supplied through the first data line D1 to the first subpixel in response to the seventh gate pulse from the seventh gate line G7. The second TFT supplies the −G data voltage supplied through the first data line D1 to the second subpixel in response to the eighth gate pulse from an eighth gate line G8. The first subpixel is charged to the −R data voltage during the first half of the fourth horizontal period. Subsequently, the second subpixel is charged to the −G data voltage during the second half of the fourth horizontal period. The third TFT supplies the +B data voltage supplied through the second data line D2 to the third subpixel in response to the seventh gate pulse. The fourth TFT supplies the +W data voltage supplied through the second data line D2 to the fourth subpixel in response to the eighth gate pulse. The third subpixel is charged to the +B data voltage during the first half of the fourth horizontal period. Subsequently, the fourth subpixel is charged to the +W data voltage during the second half of the fourth horizontal period. The fifth TFT supplies the −R data voltage supplied through the third data line D3 to the fifth subpixel in response to the seventh gate pulse. The sixth TFT supplies the −G data voltage supplied through the third data line D3 to the sixth subpixel in response to the eighth gate pulse. The fifth subpixel is charged to the −R data voltage during the first half of the fourth horizontal period. Subsequently, the sixth subpixel is charged to the −G data voltage during the second half of the fourth horizontal period. The seventh TFT supplies the +B data voltage supplied through the fourth data line D4 to the seventh subpixel in response to the seventh gate pulse. The eighth TFT supplies the +W data voltage supplied through the fourth data line D4 to the eighth subpixel in response to the eighth gate pulse. The seventh subpixel is charged to the +B data voltage during the first half of the fourth horizontal period. Subsequently, the eighth subpixel is charged to the +W data voltage during the second half of the fourth horizontal period.

The degradation of image quality of the display device, including, for example, a flicker, line noise, and color distortion, may be generated when charge amounts of subpixels of each color are uniform, and the subpixels of each color lean toward one polarity. The display device according to the present invention may improve the image quality using the structure of the example pixel array shown in FIGS. 2A and 2B, other example structures disclosed herein, or other similar structures.

The luminance of the display device depends on the charge amount of the subpixels. For example, as the charge amount of the data voltage of the subpixel increases in a normally black mode, the luminance of the subpixel increases. As shown in FIGS. 2A and 2B, the subpixels may be divided into strong charge subpixels and weak charge subpixels by the charge order of the data voltage. Because the strong charge subpixel is charged to a previous data voltage and then is charged to a data voltage of the same polarity as the previous data voltage, the strong charge subpixel has a relatively large amount of charge due to a pre-charging effect. On the contrary, because the weak charge subpixel is charged to a previous data voltage and then is charged to a data voltage of a polarity opposite the previous data voltage, a charge amount of the weak charge subpixel has a relatively small amount of charge. For example, as shown in FIG. 2A, the first subpixel on a second line L2 is a −B weak charge subpixel which is charged to the +G data voltage and then is charged to the −B data voltage. In the same manner as the first subpixel, the third subpixel on the second line L2 is a +R weak charge subpixel which is charged to the −W data voltage and then is charged to the +R data voltage. Further, the second subpixel on the second line L2 is a −W strong charge subpixel which is charged to the −B data voltage and then is charged to the −W data voltage. The fourth subpixel on the second line L2 is a +G strong charge subpixel which is charged to the +R data voltage and then is charged to the +G data voltage. All of the W subpixels and the G subpixels each having a high luminance ratio are configured as the strong charge subpixels. All of the R subpixels and the B subpixels each having a relatively low luminance ratio are configured as the weak charge subpixels.

When all of the subpixels of the same color are the weak charge subpixels or the strong charge subpixels, and are disposed along the vertical line or in a stripe pattern along the vertical line, the luminance of the subpixels of the same color varies as compared with the subpixels of other colors. Hence, the color distortion and the line noise may appear. As shown in FIGS. 2A and 2B, the display device according to the example embodiment of the present invention may prevent the color distortion by uniformly distributing the strong charge subpixels and the weak charge subpixels. It may also prevent the color distortion and a luminance difference between the lines by arranging the subpixels of the same color in the hexagonal shape.

As can be seen from FIGS. 2A and 2B, all of the W subpixels are configured as the strong charge subpixels. Further, all of the G subpixels having the next largest luminance ratio after the W subpixels are configured as the strong charge subpixels. Hence, the display device according to the example embodiment of the present invention may increase the luminance of the W subpixels even at a relatively small voltage in the normally black mode, and thus may reduce power consumption without the color distortion.

When the polarities of the data voltages charged to the subpixels of the same color are not uniform and one polarity appears as a dominant polarity, the common voltage leans toward the dominant polarity. Hence, a luminance difference between the positive polarity subpixel and the negative polarity subpixel is created, thereby generating the flicker. When subpixels of a predetermined color have a dominant polarity, the predetermined color appears more strongly or more weakly than other colors. As shown in FIGS. 2A and 2B, the display device according to the example embodiment of the present invention arranges the subpixels so as to balance the polarities of the subpixels of the same color. In the subpixels of the same color arranged in the hexagonal shape, the number of positive polarity subpixels is equal to the number of negative polarity subpixels. For example, as shown in FIG. 2A, the R subpixels of the first polarity are disposed at the upper part of the hexagon connecting the R subpixels, and the R subpixels of second polarity are disposed at the lower part of the hexagon. In the hexagon connecting the W subpixels, the vertically adjacent W subpixels have opposite polarities and the horizontally adjacent W subpixels have opposite polarities.

FIGS. 2A and 2B show the subpixels of four colors R, W, G, and B. Other colors may be used for the subpixels. For example, the colors of the image may be represented using yellow (Y), cyan (C), and magenta (M) colors, instead of the R, G, and B colors.

Figure 4A:
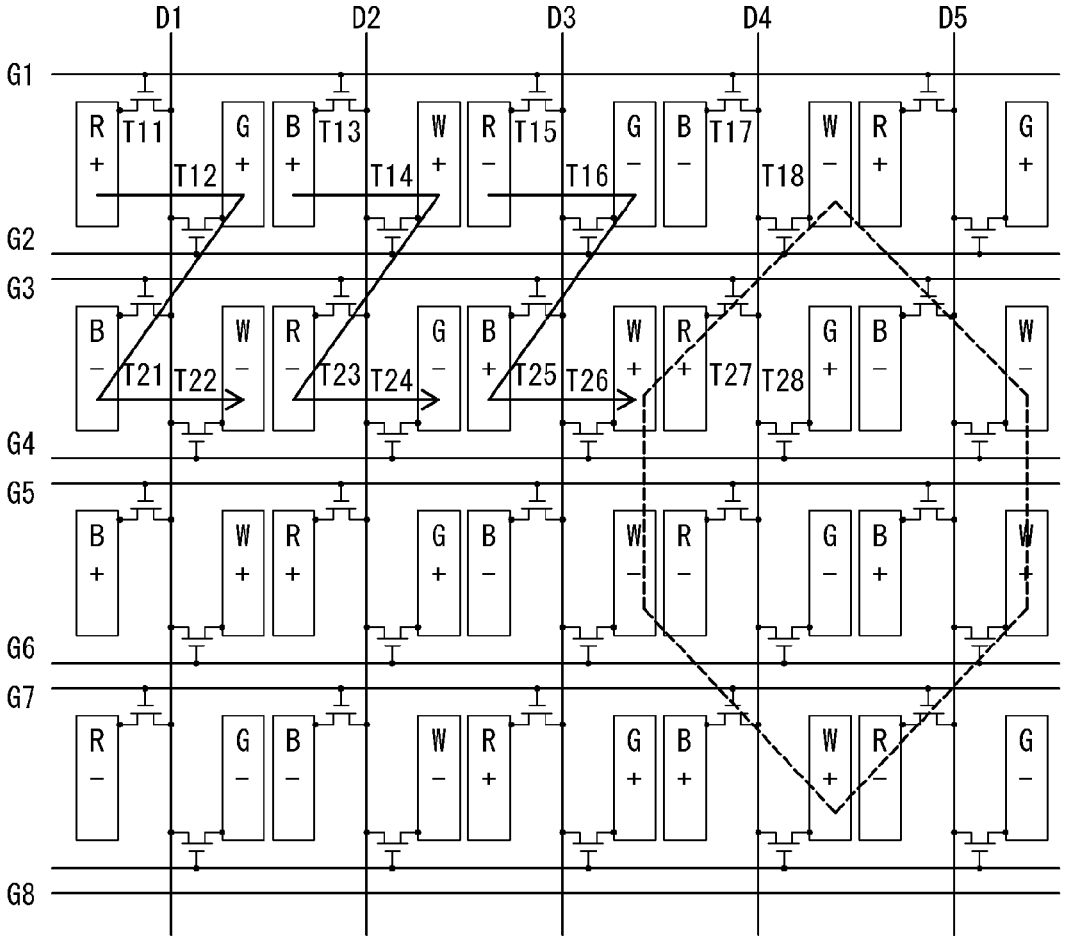
FIGS. 4A and 4B are equivalent circuit diagrams showing a portion of a pixel array according to a second example embodiment of the invention.
Figure 4B:
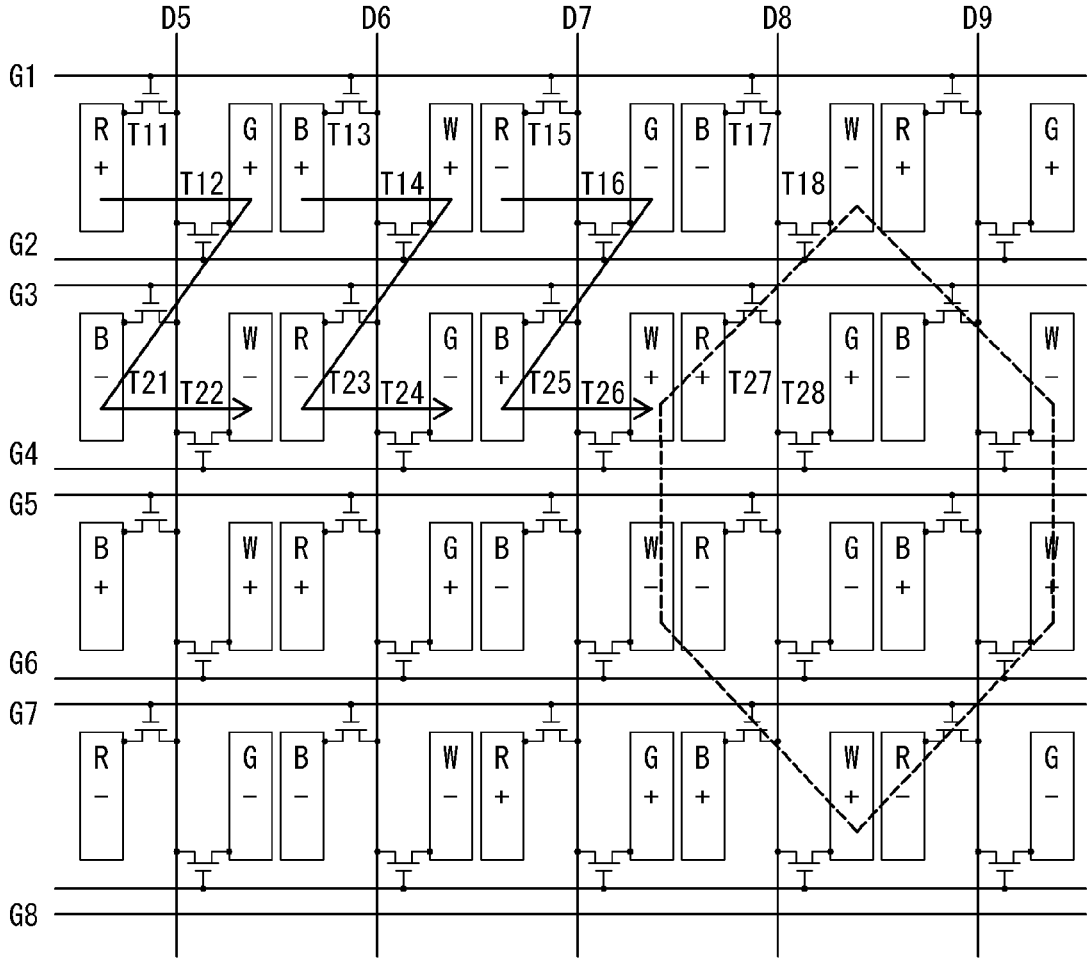
Figure 5:
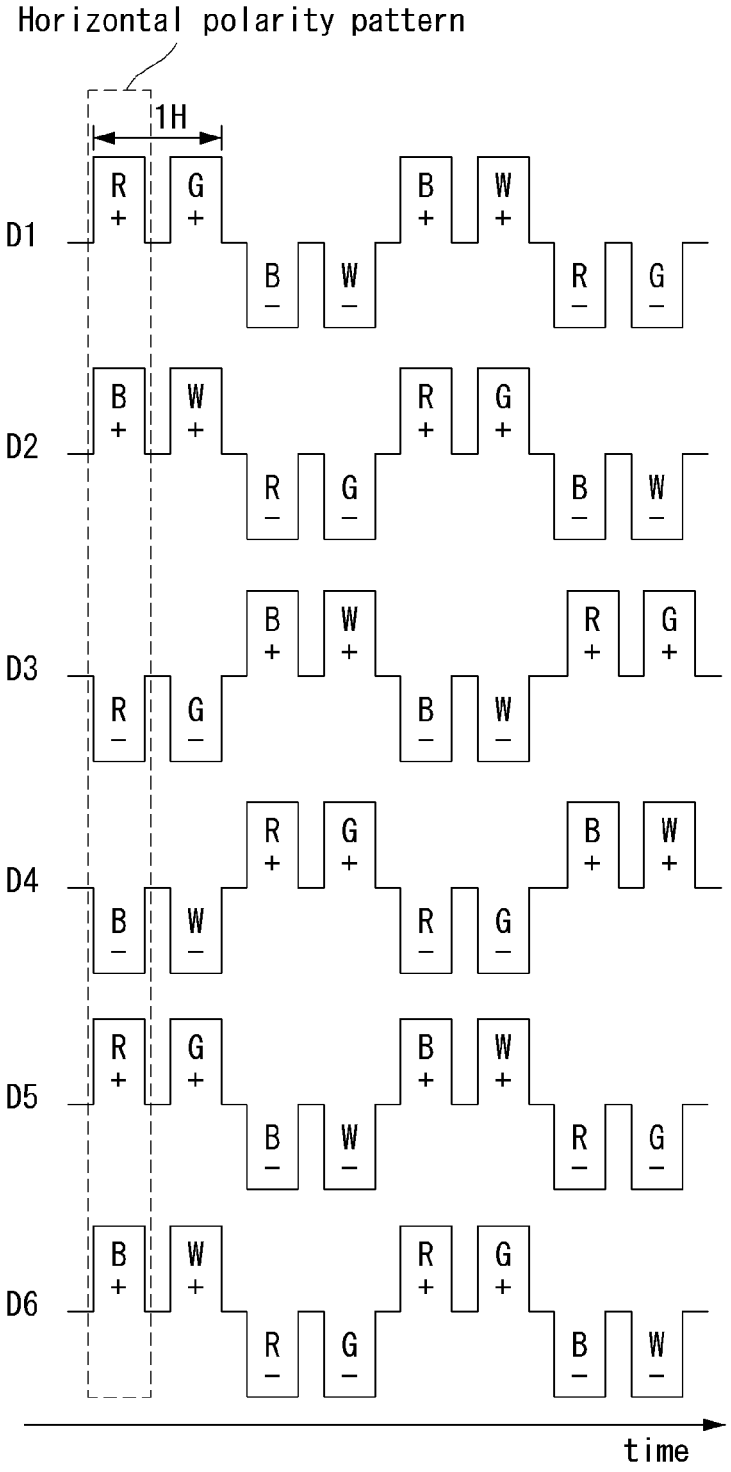
FIG. 5 is a waveform diagram showing a data voltage applied to the pixel array shown in FIGS. 4A and 4B.

FIGS. 4A and 4B depict an equivalent circuit diagram showing a portion of a pixel array according to the second example embodiment of the invention. FIG. 5 is a waveform diagram showing a data voltage applied to the pixel array shown in FIGS. 4A and 4B.

As shown in FIGS. 4A to 5, the second example embodiment of the invention arranges subpixels of the same color on four adjacent horizontal lines of the pixel array in a hexagonal shape as indicated by the dotted line.

The TFTs are disposed in a zigzag shape along data lines D1 to Dm, so as to implement the DRD type pixel array. Two adjacent subpixels positioned on the left and right sides of one data line, respectively, are sequentially charged to a data voltage from the one data line and share the one data line with each other. The output channels of the source driver ICs of the data driver 12 are respectively connected to the data lines D1 to Dm.

The source driver ICs invert a horizontal polarity pattern in a cycle of two output channels. For example, during the N-th frame period, a horizontal polarity pattern of the data voltages output through the (4i+1)-th and (4i+2)-th output channels of the source driver ICs is represented by "++", and a horizontal polarity pattern of the data voltages output through the (4i+3)-th and (4i+4)-th output channels of the source driver ICs is represented by "−−". Each of the source driver ICs may invert polarities of the output channels in each frame period. In this instance, during the (N+1)-th frame period, a horizontal polarity pattern of the data voltages output through the (4i+1)-th and (4i+2)-th output channels of the source driver ICs is represented by "−−", and a horizontal polarity pattern of the data voltages output through the (4i+3)-th and (4i+4)-th output channels of the source driver ICs is represented by "++".

In each source driver IC, the data voltages of the same polarity, which will be charged to two adjacent subpixels positioned on the left and right sides of one data line, are successively output in one horizontal period 1H. The data voltages of the same polarity are supplied to the two adjacent subpixels through the one data line in one horizontal period 1H. Thus, each of the source driver ICs of the data driver 12 inverts the polarities of the data voltages in a horizontal 2-dot and vertical 2-dot inversion scheme.

When the source driver ICs supply the data voltages, of which the polarities are inverted in the horizontal 2-dot and vertical 2-dot inversion scheme, to the data lines, a polarity pattern of the pixel array follows a horizontal 4-dot and vertical 2-dot inversion scheme due to the structure of the DRD type pixel array.

In the (4i+1)-th and (4i+4)-th horizontal lines of the pixel array, the (4i+1)-th subpixels have the first color R; the (4i+2)-th subpixels have the second color G; the (4i+3)-th subpixels have the third color B; and the (4i+4)-th subpixels have the fourth color W.

In the (4i+2)-th and (4i+3)-th horizontal lines of the pixel array, the (4i+1)-th subpixels have the third color B; the (4i+2)-th subpixels have the fourth color W; the (4i+3)-th subpixels have the first color R; and the (4i+4)-th subpixels have the second color G.

The connection between the subpixels and the data lines shown in FIGS. 4A and 4B is described below in terms of the corresponding TFTs. In the following description, a +R (or +G, +B, or +W) data voltage represents a positive R (or G, B, or W) data voltage, and a −R (or −G, −B, or −W) data voltage represents a negative R (or G, B, or W) data voltage.

In FIGS. 4A and 4B, T11 to T18 respectively denote eight TFTs disposed on the (4i+1)-th and (4i+4)-th horizontal lines of the pixel array from left to right in order. Further, T21 to T28 respectively denote eight TFTs disposed on the (4i+2)-th and (4i+3)-th horizontal lines of the pixel array from left to right in order.

During the N-th frame period, the source driver ICs output positive data voltages to the data lines D1, D2, D5, D6, D9, and D10 through the (4i+1)-th and (4i+2)-th output channels, respectively, and output negative data voltages to the data lines D3, D4, D7, and D8 through the (4i+3)-th and (4i+4)-th output channels, respectively. The data voltages output through all of the output channels of the source driver ICs are sequentially charged first to the left subpixel (i.e., the subpixel disposed to the left of the data line) and then to the right subpixel (i.e., the subpixel disposed to the right of the data line) on all of the horizontal lines of the pixel array as indicated by the arrow in FIGS. 4A and 4B. The gate driver 14 sequentially outputs the gate pulse synchronized with the data voltage.

In the (4i+1)-th horizontal line of the pixel array, the first TFT T11 supplies the +R data voltage supplied through the first data line D1 to the first subpixel in response to the first gate pulse from the first gate line G1. The second TFT T12 supplies the +G data voltage supplied through the first data line D1 to the second subpixel in response to the second gate pulse from the second gate line G2. The first subpixel is charged to the +R data voltage during the first half of the first horizontal period. Subsequently, the second subpixel is charged to the +G data voltage during the second half of the first horizontal period. The third TFT T13 supplies the +B data voltage supplied through the second data line D2 to the third subpixel in response to the first gate pulse. The fourth TFT T14 supplies the +W data voltage supplied through the second data line D2 to the fourth subpixel in response to the second gate pulse. The third subpixel is charged to the +B data voltage during the first half of the first horizontal period. Subsequently, the fourth subpixel is charged to the +W data voltage during the second half of the first horizontal period. The fifth TFT T15 supplies the −R data voltage supplied through the third data line D3 to the fifth subpixel in response to the first gate pulse. The sixth TFT T16 supplies the −G data voltage supplied through the third data line D3 to the sixth subpixel in response to the second gate pulse. The fifth subpixel is charged to the −R data voltage during the first half of the first horizontal period. Subsequently, the sixth subpixel is charged to the −G data voltage during the second half of the first horizontal period. The seventh TFT T17 supplies the −B data voltage supplied through the fourth data line D4 to the seventh subpixel in response to the first gate pulse. The eighth TFT T18 supplies the −W data voltage supplied through the fourth data line D4 to the eighth subpixel in response to the second gate pulse. The seventh subpixel is charged to the −B data voltage during the first half of the first horizontal period. Subsequently, the eighth subpixel is charged to the −W data voltage during the second half of the first horizontal period.

In the (4i+2)-th horizontal line of the pixel array, the first TFT T21 supplies the −B data voltage supplied through the first data line D1 to the first subpixel in response to the third gate pulse from a third gate line G3. The second TFT T22 supplies the −W data voltage supplied through the first data line D1 to the second subpixel in response to the fourth gate pulse from a fourth gate line G4. The first subpixel is charged to the −B data voltage during the first half of the second horizontal period. Subsequently, the second subpixel is charged to the −W data voltage during the second half of the second horizontal period. The third TFT T23 supplies the −R data voltage supplied through the second data line D2 to the third subpixel in response to the third gate pulse. The fourth TFT T24 supplies the −G data voltage supplied through the second data line D2 to the fourth subpixel in response to the fourth gate pulse. The third subpixel is charged to the −R data voltage during the first half of the second horizontal period. Subsequently, the fourth subpixel is charged to the −G data voltage during the second half of the second horizontal period. The fifth TFT T25 supplies the +B data voltage supplied through the third data line D3 to the fifth subpixel in response to the third gate pulse. The sixth TFT T26 supplies the +W data voltage supplied through the third data line D3 to a sixth subpixel in response to the fourth gate pulse. The fifth subpixel is charged to the +B data voltage during the first half of the second horizontal period. Subsequently, the sixth subpixel is charged to the +W data voltage during the second half of the second horizontal period. The seventh TFT T27 supplies the +R data voltage supplied through the fourth data line D4 to the seventh subpixel in response to the third gate pulse. The eighth TFT T28 supplies the +G data voltage supplied through the fourth data line D4 to the eighth subpixel in response to the fourth gate pulse. The seventh subpixel is charged to the +R data voltage during the first half of the second horizontal period. Subsequently, the eighth subpixel is charged to the +G data voltage during the second half of the second horizontal period.

In the (4i+3)-th horizontal line of the pixel array, the first TFT supplies the +B data voltage supplied through the first data line D1 to the first subpixel in response to the fifth gate pulse from the fifth gate line G5. The second TFT supplies the +W data voltage supplied through the first data line D1 to the second subpixel in response to the sixth gate pulse from the sixth gate line G6. The first subpixel is charged to the +B data voltage during the first half of the third horizontal period. Subsequently, the second subpixel is charged to the +W data voltage during the second half of the third horizontal period. The third TFT supplies the +R data voltage supplied through the second data line D2 to the third subpixel in response to the fifth gate pulse. The fourth TFT supplies the +G data voltage supplied through the second data line D2 to the fourth subpixel in response to the sixth gate pulse. The third subpixel is charged to the +R data voltage during the first half of the third horizontal period. Subsequently, the fourth subpixel is charged to the +G data voltage during the second half of the third horizontal period. The fifth TFT supplies the −B data voltage supplied through the third data line D3 to the fifth subpixel in response to the fifth gate pulse. The sixth TFT supplies the −W data voltage supplied through the third data line D3 to the sixth subpixel in response to the sixth gate pulse. The fifth subpixel is charged to the −B data voltage during the first half of the third horizontal period. Subsequently, the sixth subpixel is charged to the −W data voltage during the second half of the third horizontal period. The seventh TFT supplies the −R data voltage supplied through the fourth data line D4 to the seventh subpixel in response to the fifth gate pulse. The eighth TFT supplies the −G data voltage supplied through the fourth data line D4 to the eighth subpixel in response to the sixth gate pulse. The seventh subpixel is charged to the −R data voltage during the first half of the third horizontal period. Subsequently, the eighth subpixel is charged to the −G data voltage during the second half of the third horizontal period.

In the (4i+4)-th horizontal line of the pixel array, the first TFT supplies the −R data voltage supplied through the first data line D1 to the first subpixel in response to the seventh gate pulse from the seventh gate line G7. The second TFT supplies the −G data voltage supplied through the first data line D1 to the second subpixel in response to the eighth gate pulse from the eighth gate line G8. The first subpixel is charged to the −R data voltage during the first half of the fourth horizontal period. Subsequently, the second subpixel is charged to the −G data voltage during the second half of the fourth horizontal period. The third TFT supplies the −B data voltage supplied through the second data line D2 to the third subpixel in response to the seventh gate pulse. The fourth TFT supplies the −W data voltage supplied through the second data line D2 to the fourth subpixel in response to the eighth gate pulse. The third subpixel is charged to the −B data voltage during the first half of the fourth horizontal period. Subsequently, the fourth subpixel is charged to the −W data voltage during the second half of the fourth horizontal period. The fifth TFT supplies the +R data voltage supplied through the third data line D3 to the fifth subpixel in response to the seventh gate pulse. The sixth TFT supplies the +G data voltage supplied through the third data line D3 to the sixth subpixel in response to the eighth gate pulse. The fifth subpixel is charged to the +R data voltage during the first half of the fourth horizontal period. Subsequently, the sixth subpixel is charged to the +G data voltage during the second half of the fourth horizontal period. The seventh TFT supplies the +B data voltage supplied through the fourth data line D4 to the seventh subpixel in response to the seventh gate pulse. The eighth TFT supplies the +W data voltage supplied through the fourth data line D4 to the eighth subpixel in response to the eighth gate pulse. The seventh subpixel is charged to the +B data voltage during the first half of the fourth horizontal period. Subsequently, the eighth subpixel is charged to the +W data voltage during the second half of the fourth horizontal period.

In the pixel arrays shown in FIGS. 2A and 2B and FIGS. 4A and 4B, the R, G, and B subpixels, of which the polarities are inverted in the dot inversion scheme, are arranged in the hexagonal shape (or honeycomb shape) based on the same color. Also, subpixels of the same color are uniformly distributed as strong charge subpixels and weak charge subpixels. Further, the W subpixels are configured as the strong charge subpixels. The polarities of the subpixels of each color are balanced. As a result, the display device according to the example embodiments of the present invention may exhibit improved image quality, with less flicker, line noise, and color distortion.

Figure 6:
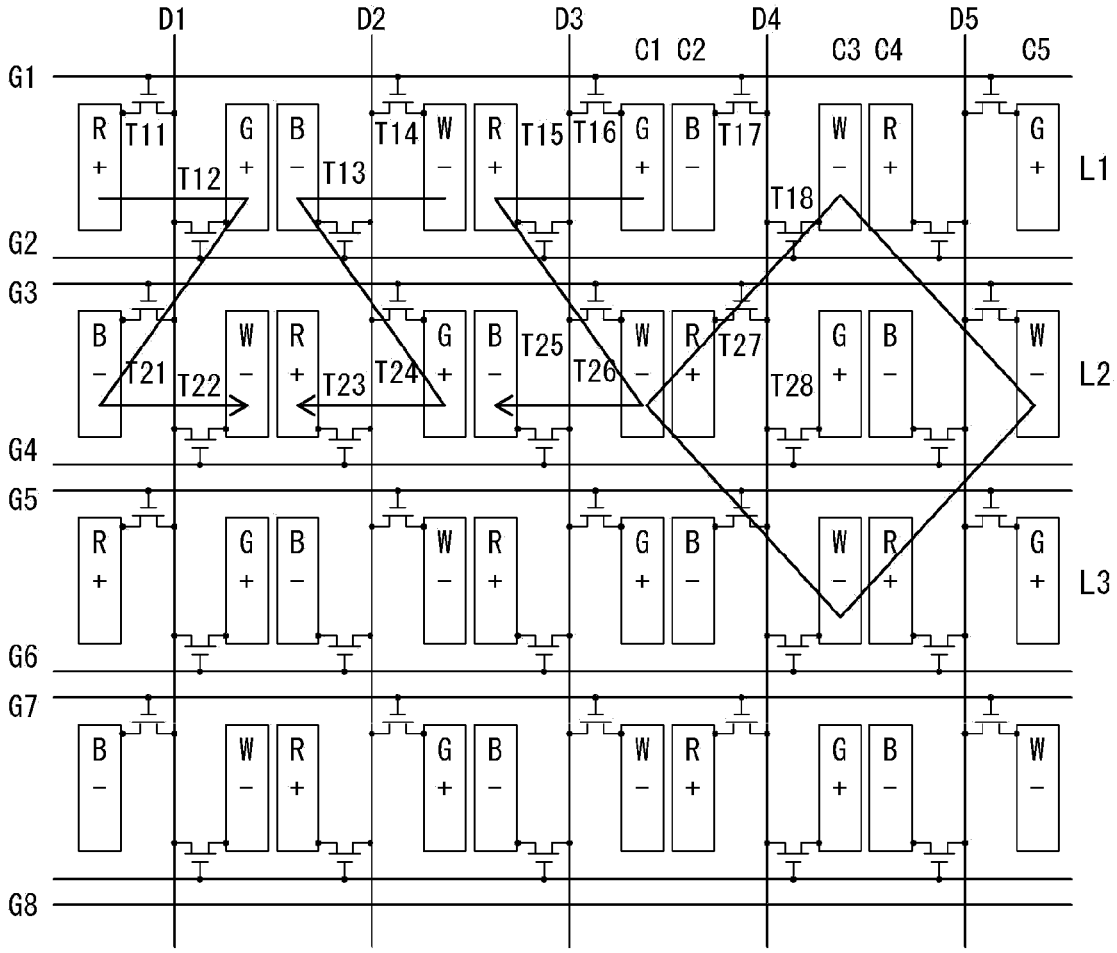
FIG. 6 is an equivalent circuit diagram showing a portion of a pixel array according to a third example embodiment of the invention.

FIG. 6 is an equivalent circuit diagram showing a portion of a pixel array according to the third example embodiment of the invention.

As shown in FIG. 6, subpixels of the same color are arranged on three adjacent horizontal lines of a pixel array in a diamond (or rhombus) shape. The W subpixels may increase the luminance of the input image and may reduce power consumption of the display device. One diamond has the size disposed on five vertical lines C1 to C5 and three horizontal lines L1 to L3.

The TFTs are disposed in a zigzag shape along data lines D1 to DM, so as to implement the DRD type pixel array. Two adjacent subpixels positioned on the left and right sides of one data line are sequentially charged to a data voltage from the one data line and share the one data line with each other. The output channels of the source driver ICs of the data driver 12 are respectively connected to the data lines D1 to Dm.

The polarities of the data voltages output through the odd-numbered output channels of the source driver ICs are opposite to the polarities of the data voltages output through the even-numbered output channels of the source driver ICs. Thus, a horizontal polarity pattern of the data voltages simultaneously output from the output channels of the source driver ICs has a repeat pattern of "+−+−" during the N-th frame period and has a repeat pattern of "−+−+" during the (N+1)-th frame period.

In each source driver IC, the data voltages of the same polarity, which will be respectively charged to two adjacent subpixels positioned on the left and right sides of one data line, are successively output in one horizontal period 1H. The data voltages of the same polarity are sequentially supplied to the two adjacent subpixels through the one data line in one horizontal period 1H. Thus, each of the source driver ICs of the data driver 12 inverts the polarities of the data voltages in a horizontal 1-dot and vertical 2-dot inversion scheme.

When the source driver ICs supply the data voltages, of which the polarities are inverted in the horizontal 1-dot and vertical 2-dot inversion scheme, to the data lines, a polarity pattern of the pixel array follows a horizontal 2-dot and vertical 2-dot inversion scheme due to the structure of the DRD type pixel array.

In the odd-numbered horizontal lines of the pixel array, the (4i+1)-th subpixels have the first color R; the (4i+2)-th subpixels have the second color G; the (4i+3)-th subpixels have the third color B; and the (4i+4)-th subpixels have the fourth color W.

In the even-numbered horizontal lines of the pixel array, the (4i+1)-th subpixels have the third color B; the (4i+2)-th subpixels have the fourth color W; the (4i+3)-th subpixels have the first color R; and the (4i+4)-th subpixels have the second color G.

The connection between the subpixels and the data lines shown in FIG. 6 is described below in terms of the TFTs. In the following description, a +R (or +G, +B, or +W) data voltage represents a positive R (or G, B, and W) data voltage, and a −R (or −G, −B, or −W) data voltage represents a negative R (or G, B, and W) data voltage. In FIG. 6, T11 to T18 respectively denote eight TFTs disposed on one of the odd-numbered horizontal lines of the pixel array from left to right in order. Further, T21 to T28 respectively denote eight TFTs disposed on one of the even-numbered horizontal lines of the pixel array from left to right in order.

During the N-th frame period, the source driver ICs output the positive data voltage to the data lines D1, D3, and D5, respectively, through the odd-numbered output channels and output the negative data voltage to the data lines D2, D4, and D6, respectively, through the even-numbered output channels. The data voltages output through the odd-numbered output channels of the source driver ICs are sequentially charged first to the left subpixel (i.e., the subpixel disposed to the left of the data line) and then to the right subpixel (i.e., the subpixel disposed to the right of the data line) as indicated by the arrow of FIG. 6. On the other hand, the data voltages output through the even-numbered output channels of the source driver ICs are sequentially charged first to the right subpixel and then to the left subpixel as indicated by the arrow of FIG. 6. The gate driver 14 sequentially outputs the gate pulse synchronized with the data voltage.

In the odd-numbered horizontal line of the pixel array, the first TFT T11 supplies the +R data voltage supplied through the first data line D1 to the first subpixel in response to the first gate pulse from the first gate line G1. The second TFT T12 supplies the +G data voltage supplied through the first data line D1 to the second subpixel in response to the second gate pulse from the second gate line G2. The first subpixel is charged to the +R data voltage during the first half of an odd-numbered horizontal period. Subsequently, the second subpixel is charged to the +G data voltage during the second half of the odd-numbered horizontal period. The third TFT T13 supplies the −B data voltage supplied through the second data line D2 to the third subpixel in response to the second gate pulse. The fourth TFT T14 supplies the −W data voltage supplied through the second data line D2 to the fourth subpixel in response to the first gate pulse. The third subpixel is charged to the −B data voltage during the first half of the odd-numbered horizontal period. Subsequently, the fourth subpixel is charged to the −W data voltage during the second half of the odd-numbered horizontal period. The fifth TFT T15 supplies the +R data voltage supplied through the third data line D3 to the fifth subpixel in response to the second gate pulse. The sixth TFT T16 supplies the +G data voltage supplied through the third data line D3 to the sixth subpixel in response to the first gate pulse. The fifth subpixel is charged to the +R data voltage during the first half of the odd-numbered horizontal period. Subsequently, the sixth subpixel is charged to the +G data voltage during the second half of the odd-numbered horizontal period. The seventh TFT T17 supplies the −B data voltage supplied through the fourth data line D4 to the seventh subpixel in response to the first gate pulse. The eighth TFT T18 supplies the −W data voltage supplied through the fourth data line D4 to the eighth subpixel in response to the second gate pulse. The seventh subpixel is charged to the −B data voltage during the first half of the odd-numbered horizontal period. Subsequently, the eighth subpixel is charged to the −W data voltage during the second half of the odd-numbered horizontal period.

In the even-numbered horizontal line of the pixel array, the first TFT T21 supplies the −B data voltage supplied through the first data line D1 to the first subpixel in response to the third gate pulse from the third gate line G3. The second TFT T22 supplies the −W data voltage supplied through the first data line D1 to the second subpixel in response to the fourth gate pulse from the fourth gate line G4. The first subpixel is charged to the −B data voltage during the first half of an even-numbered horizontal period. Subsequently, the second subpixel is charged to the −W data voltage during the second half of the even-numbered horizontal period. The third TFT T23 supplies the +R data voltage supplied through the second data line D2 to the third subpixel in response to the fourth gate pulse. The fourth TFT T24 supplies the +G data voltage supplied through the second data line D2 to the fourth subpixel in response to the third gate pulse. The third subpixel is charged to the +R data voltage during the first half of the even-numbered horizontal period. Subsequently, the fourth subpixel is charged to the +G data voltage during the second half of the even-numbered horizontal period. The fifth TFT T25 supplies the −B data voltage supplied through the third data line D3 to the fifth subpixel in response to the fourth gate pulse. The sixth TFT T26 supplies the −W data voltage supplied through the third data line D3 to the sixth subpixel in response to the third gate pulse. The fifth subpixel is charged to the −B data voltage during the first half of the even-numbered horizontal period. Subsequently, the sixth subpixel is charged to the −W data voltage during the second half of the even-numbered horizontal period. The seventh TFT T27 supplies the +R data voltage supplied through the fourth data line D4 to the seventh subpixel in response to the third gate pulse. The eighth TFT T28 supplies the +G data voltage supplied through the fourth data line D4 to the eighth subpixel in response to the fourth gate pulse. The seventh subpixel is charged to the +R data voltage during the first half of the even-numbered horizontal period. Subsequently, the eighth subpixel is charged to the +G data voltage during the second half of the even-numbered horizontal period.

Figure 7:
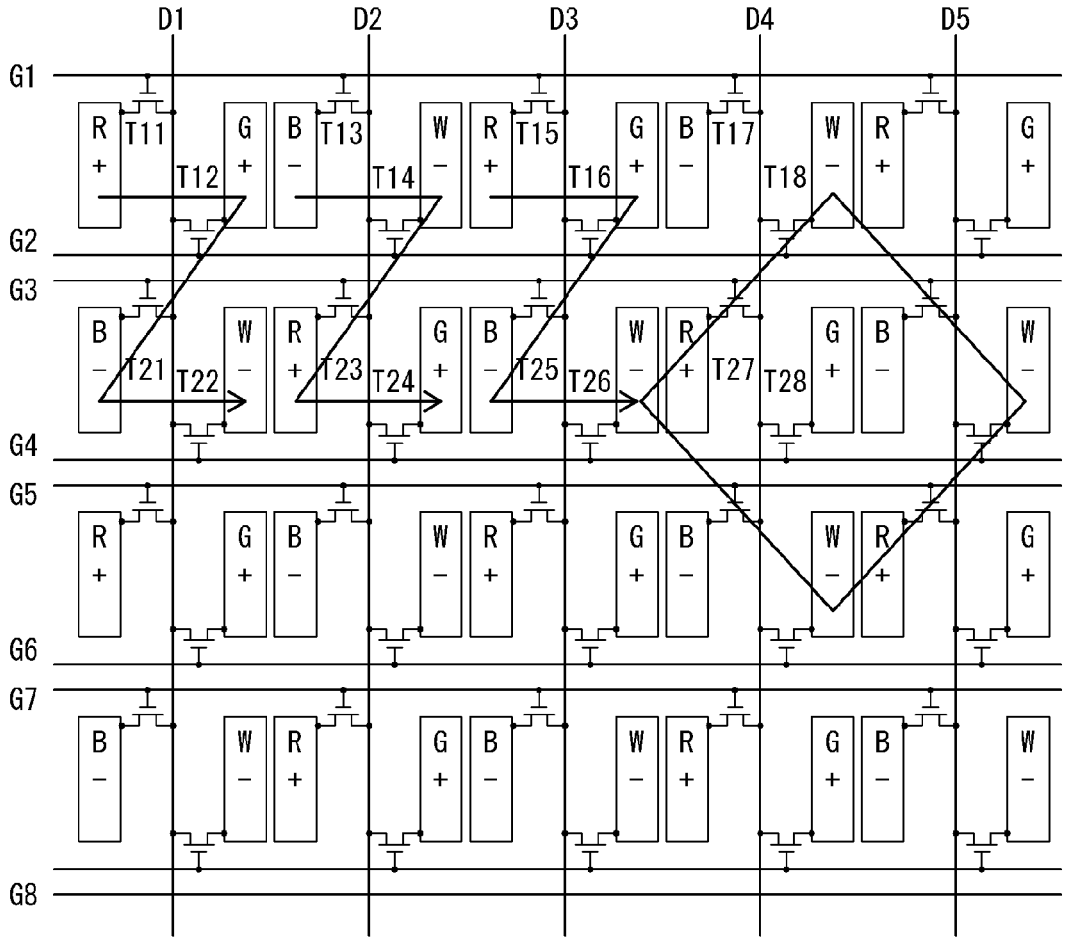
FIG. 7 is an equivalent circuit diagram showing a portion of a pixel array according to a fourth example embodiment of the invention.

FIG. 7 is an equivalent circuit diagram showing a portion of a pixel array according to the fourth example embodiment of the invention.

As shown in FIG. 7, subpixels of the same color are arranged on three adjacent horizontal lines of a pixel array in a diamond shape.

The TFTs are disposed in a zigzag shape along data lines D1 to Dm, so as to implement the DRD type pixel array. Two adjacent subpixels positioned on the left and right sides of one data line are sequentially charged to a data voltage from the one data line and share the one data line with each other. The output channels of the source driver ICs of the data driver 12 are respectively connected to the data lines D1 to Dm.

The polarities of the data voltages output through the odd-numbered output channels of the source driver ICs are opposite to the polarities of the data voltages output through even-numbered output channels of the source driver ICs. Thus, a horizontal polarity pattern of the data voltages simultaneously output from the output channels of the source driver ICs has a repeat pattern of "+−+−" during the N-th frame period and has a repeat pattern of "−+−+" during the (N+1)-th frame period.

In each source driver IC, the data voltages of the same polarity, which will be charged to two adjacent subpixels positioned on the left and right sides of one data line, are successively output in one horizontal period 1H. The data voltages of the same polarity are sequentially supplied to the two adjacent subpixels through the one data line in one horizontal period 1H. Thus, each of the source driver ICs of the data driver 12 inverts the polarities of the data voltages in a horizontal 1-dot and vertical 2-dot inversion scheme.

When the source driver ICs supply the data voltages, of which the polarities are inverted in the horizontal 1-dot and vertical 2-dot inversion scheme, to the data lines, a polarity pattern of the pixel array follows a horizontal 2-dot and vertical 2-dot inversion scheme due to the structure of the DRD type pixel array.

In the odd-numbered horizontal lines of the pixel array, the (4i+1)-th subpixels have the first color R; the (4i+2)-th subpixels have the second color G; the (4i+3)-th subpixels have the third color B; and the (4i+4)-th subpixels have the fourth color W.

In the even-numbered horizontal lines of the pixel array, the (4i+1)-th subpixels have the third color B; the (4i+2)-th subpixels have the fourth color W; the (4i+3)-th subpixels have the first color R; and the (4i+4)-th subpixels have the second color G.

The connection between the subpixels and the data lines shown in FIG. 7 is described below in terms of the TFTs. In the following description, a +R (or +G, +B, or +W) data voltage represents a positive R (or G, B, and W) data voltage, and a −R (or −G, −B, or −W) data voltage represents a negative R (or G, B, and W) data voltage. In FIG. 7, T11 to T14 respectively denote four TFTs disposed on one of the odd-numbered horizontal lines of the pixel array from left to right in order. Further, T21 to T24 respectively denote four TFTs disposed on one of the even-numbered horizontal lines of the pixel array from left to right in order.

During the N-th frame period, the source driver ICs output the positive data voltage to the data lines D1, D3, and D5, respectively, through the odd-numbered output channels and output the negative data voltage to the data lines D2, D4, and D6, respectively, through the even-numbered output channels. The data voltages are sequentially charged first to the left subpixel (i.e., the subpixel disposed to the left of the data line) and then to the right subpixel (i.e., the subpixel disposed to the right of the data line) on each horizontal line of the pixel array as indicated by the arrows of FIG. 7.

In the odd-numbered horizontal line of the pixel array, the first TFT T11 supplies the +R data voltage supplied through the first data line D1 to the first subpixel in response to the first gate pulse from the first gate line G1. The second TFT T12 supplies the +G data voltage supplied through the first data line D1 to the second subpixel in response to the second gate pulse from the second gate line G2. The first subpixel is charged to the +R data voltage during the first half of an odd-numbered horizontal period. Subsequently, the second subpixel is charged to the +G data voltage during the second half of the odd-numbered horizontal period. The third TFT T13 supplies the −B data voltage supplied through the second data line D2 to the third subpixel in response to the first gate pulse. The fourth TFT T14 supplies the −W data voltage supplied through the second data line D2 to the fourth subpixel in response to the second gate pulse. The third subpixel is charged to the −B data voltage during the first half of the odd-numbered horizontal period. Subsequently, the fourth subpixel is charged to the −W data voltage during the second half of the odd-numbered horizontal period.

In the even-numbered horizontal line of the pixel array, the first TFT T21 supplies the −B data voltage supplied through the first data line D1 to the first subpixel in response to the third gate pulse from the third gate line G3. The second TFT T22 supplies the −W data voltage supplied through the first data line D1 to the second subpixel in response to a fourth gate pulse from a fourth gate line G4. The first subpixel is charged to the −B data voltage during the first half of an even-numbered horizontal period. Subsequently, the second subpixel is charged to the −W data voltage during the second half of the even-numbered horizontal period. The third TFT T23 supplies the +R data voltage supplied through the second data line D2 to the third subpixel in response to the third gate pulse. The fourth TFT T24 supplies the +G data voltage supplied through the second data line D2 to the fourth subpixel in response to the fourth gate pulse. The third subpixel is charged to the +R data voltage during the first half of the even-numbered horizontal period. Subsequently, the fourth subpixel is charged to the +G data voltage during the second half of the even-numbered horizontal period.

Figure 8:
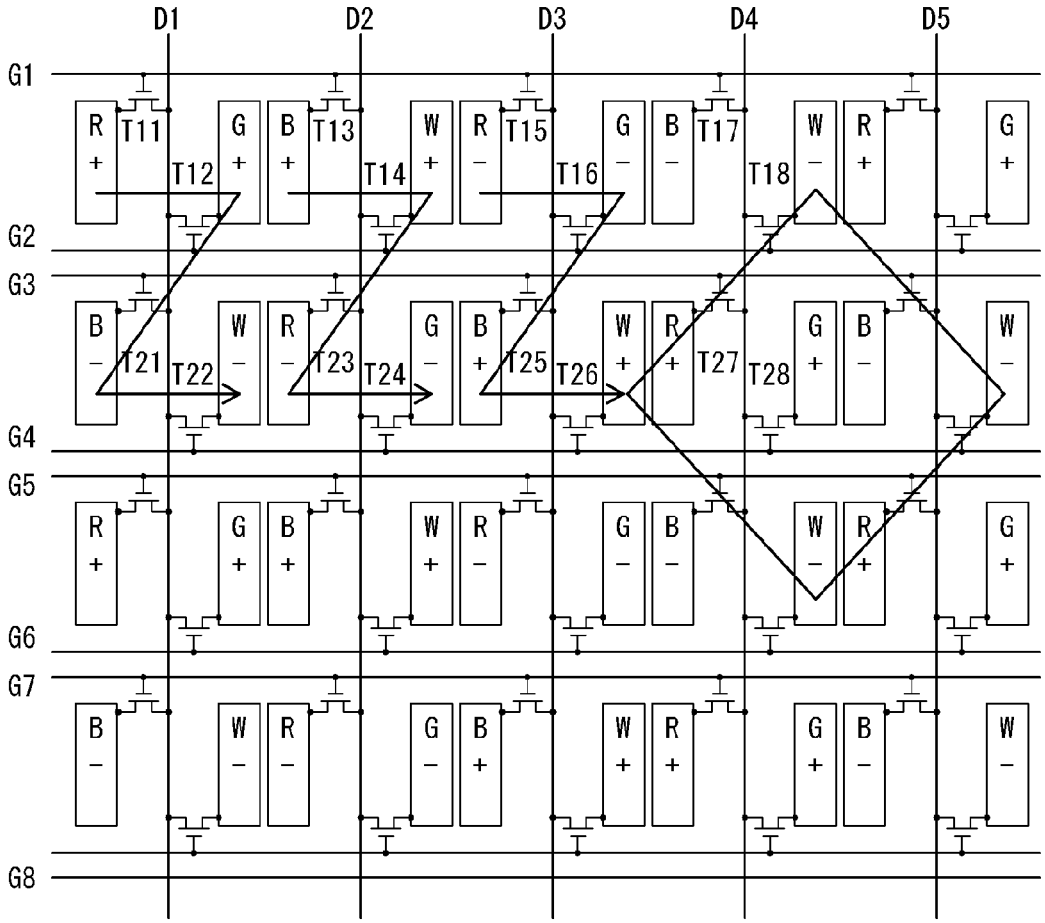
FIG. 8 is an equivalent circuit diagram showing a portion of a pixel array according to a fifth example embodiment of the invention.

FIG. 8 is an equivalent circuit diagram showing a portion of a pixel array according to the fifth example embodiment of the invention.

As shown in FIG. 8, subpixels of the same color are arranged on three adjacent horizontal lines of a pixel array in a diamond shape.

The TFTs are disposed in a zigzag shape along data lines D1 to Dm, so as to implement the DRD type pixel array. Two adjacent subpixels positioned on the left and right sides of one data line are sequentially charged to a data voltage from the one data line and share the one data line with each other. The output channels of the source driver ICs of the data driver 12 are respectively connected to the data lines D1 to Dm.

The polarities of the data voltages output through the (4i+1)-th and (4i+2)-th output channels of the source driver ICs are opposite to the polarities of the data voltages output through the (4i+3)-th and (4i+4)th output channels of the source driver ICs. Thus, a horizontal polarity pattern of the data voltages simultaneously output from the output channels of the source driver ICs has a repeat pattern of "++−−" during the N-th frame period and has a repeat pattern of "−−++" during the (N+1)-th frame period.

In each source driver IC, the data voltages of the same polarity, which will be charged to two adjacent subpixels positioned on the left and right sides of one data line, are successively output in one horizontal period 1H. The data voltages of the same polarity are sequentially supplied to the two adjacent subpixels through the one data line in one horizontal period 1H. Thus, each of the source driver ICs of the data driver 12 inverts the polarities of the data voltages in a horizontal 2-dot and vertical 2-dot inversion scheme.

When the source driver ICs supply the data voltages, of which the polarities are inverted in the horizontal 2-dot and vertical 2-dot inversion scheme, to the data lines, a polarity pattern of the pixel array follows a horizontal 4-dot and vertical 2-dot inversion scheme due to the structure of the DRD type pixel array.

In the odd-numbered horizontal lines of the pixel array, the (4i+1)-th subpixels have the first color R; the (4i+2)-th subpixels have the second color G; the (4i+3)-th subpixels have the third color B; and the (4i+4)-th subpixels have the fourth color W.

In the even-numbered horizontal lines of the pixel array, the (4i+1)-th subpixels have the third color B; the (4i+2)-th subpixels have the fourth color W; the (4i+3)-th subpixels have the first color R; and the (4i+4)-th subpixels have the second color G.

The connection between the subpixels and the data lines shown in FIG. 8 is described below in terms of the TFTs. In the following description, a +R (or +G, +B, or +W) data voltage represents a positive R (or G, B, or W) data voltage, and a −R (or −G, −B, or −W) data voltage represent a negative R (or G, B, or W) data voltage. In FIG. 8, T11 to T18 respectively denote eight TFTs disposed on one of the odd-numbered horizontal lines of the pixel array from left to right in order. Further, T21 to T28 respectively denote eight TFTs disposed on one of the even-numbered horizontal lines of the pixel array from left to right in order.

During the N-th frame period, the source driver ICs output the positive data voltage to the data lines D1, D2, D5, and D6 through the (4i+1)-th and (4i+2)-th output channels, respectively, and output the negative data voltage to the data lines D3 and D4 through the (4i+3)-th and (4i+4)-th output channels, respectively. The data voltages are sequentially charged first to the left subpixel (i.e., the subpixel disposed to the left of the data line) and then to the right subpixel (i.e., the subpixel disposed to the right of the data line) on each horizontal line of the pixel array as indicated by the arrows of FIG. 8.

In the odd-numbered horizontal line of the pixel array, the first TFT T11 supplies the +R data voltage supplied through the first data line D1 to the first subpixel in response to the first gate pulse from the first gate line G1. The second TFT T12 supplies the +G data voltage supplied through the first data line D1 to the second subpixel in response to the second gate pulse from the second gate line G2. The first subpixel is charged to the +R data voltage during the first half of an odd-numbered horizontal period. Subsequently, the second subpixel is charged to the +G data voltage during the second half of the odd-numbered horizontal period. The third TFT T13 supplies the +B data voltage supplied through the second data line D2 to the third subpixel in response to the first gate pulse. The fourth TFT T14 supplies the +W data voltage supplied through the second data line D2 to the fourth subpixel in response to the second gate pulse. The third subpixel is charged to the +B data voltage during the first half of the odd-numbered horizontal period. Subsequently, the fourth subpixel is charged to the +W data voltage during the second half of the odd-numbered horizontal period. The fifth TFT T15 supplies the −R data voltage supplied through the third data line D3 to the fifth subpixel in response to the first gate pulse. The sixth TFT T16 supplies the −G data voltage supplied through the third data line D3 to the sixth subpixel in response to the second gate pulse. The fifth subpixel is charged to the −R data voltage during the first half of the odd-numbered horizontal period. Subsequently, the sixth subpixel is charged to the −G data voltage during the second half of the odd-numbered horizontal period. The seventh TFT T17 supplies the −B data voltage supplied through the fourth data line D4 to the seventh subpixel in response to the first gate pulse. The eighth TFT T18 supplies the −W data voltage supplied through the fourth data line D4 to the eighth subpixel in response to the second gate pulse. The seventh subpixel is charged to the −B data voltage during the first half of the odd-numbered horizontal period. Subsequently, the eighth subpixel is charged to the −W data voltage during the second half of the odd-numbered horizontal period.

In the even-numbered horizontal line of the pixel array, the first TFT T21 supplies the −B data voltage supplied through the first data line D1 to the first subpixel in response to the third gate pulse from the third gate line G3. The second TFT T22 supplies the −W data voltage supplied through the first data line D1 to the second subpixel in response to the fourth gate pulse from the fourth gate line G4. The first subpixel is charged to the −B data voltage during the first half of an even-numbered horizontal period. Subsequently, the second subpixel is charged to the −W data voltage during the second half of the even-numbered horizontal period. The third TFT T23 supplies the −R data voltage supplied through the second data line D2 to the third subpixel in response to the third gate pulse. The fourth TFT T24 supplies the −G data voltage supplied through the second data line D2 to the fourth subpixel in response to the fourth gate pulse. The third subpixel is charged to the −R data voltage during the first half of the even-numbered horizontal period. Subsequently, the fourth subpixel is charged to the −G data voltage during the second half of the even-numbered horizontal period. The fifth TFT T25 supplies the +B data voltage supplied through the third data line D3 to the fifth subpixel in response to the third gate pulse. The sixth TFT T26 supplies the +W data voltage supplied through the third data line D3 to the sixth subpixel in response to the fourth gate pulse. The fifth subpixel is charged to the +B data voltage during the first half of the even-numbered horizontal period. Subsequently, the sixth subpixel is charged to the +W data voltage during the second half of the even-numbered horizontal period. The seventh TFT T27 supplies the +R data voltage supplied through the fourth data line D4 to the seventh subpixel in response to the third gate pulse. The eighth TFT T28 supplies the +G data voltage supplied through the fourth data line D4 to the eighth subpixel in response to the fourth gate pulse. The seventh subpixel is charged to the +R data voltage during the first half of the even-numbered horizontal period. Subsequently, the eighth subpixel is charged to the +G data voltage during the second half of the even-numbered horizontal period.

Figure 9:
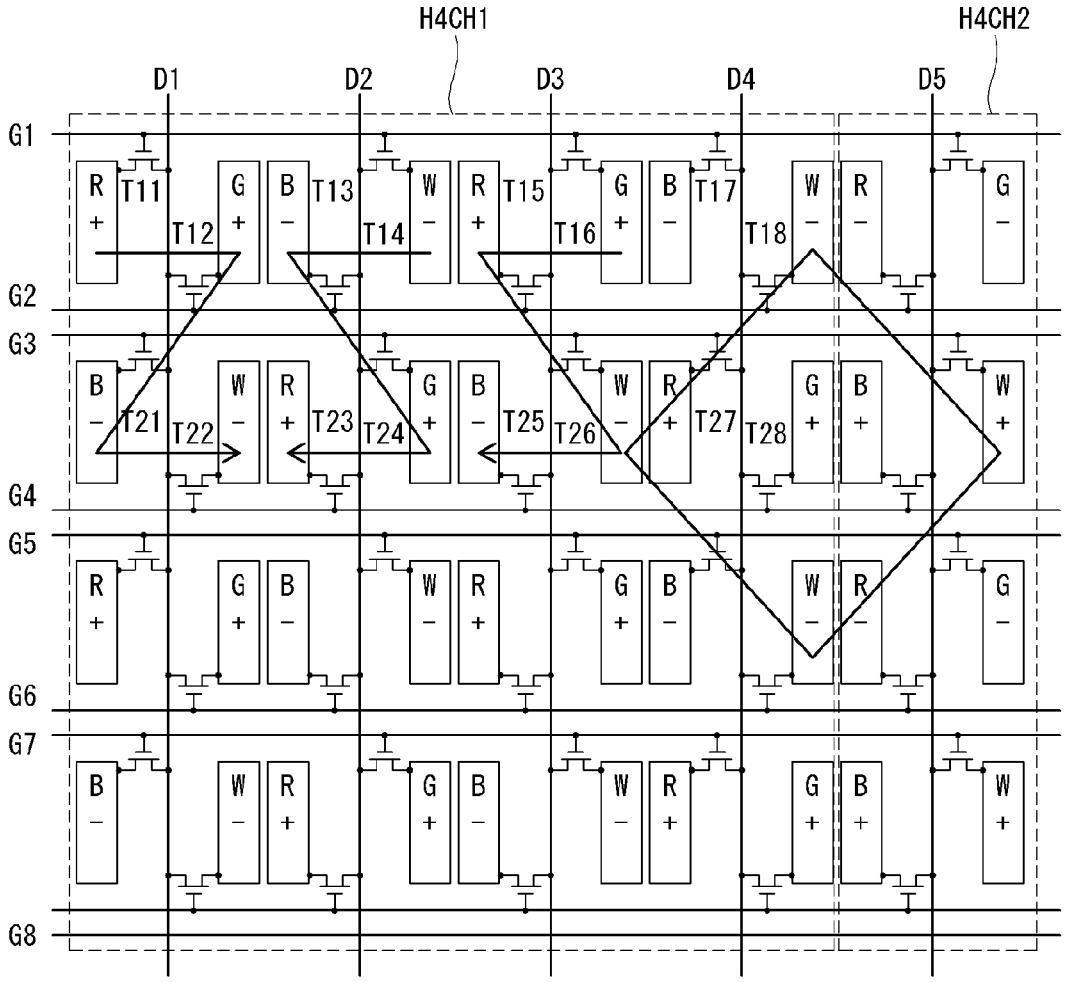
FIG. 9 is an equivalent circuit diagram showing a portion of a pixel array according to a sixth example embodiment of the invention.

FIG. 9 is an equivalent circuit diagram showing a portion of a pixel array according to the sixth example embodiment of the invention.

As shown in FIG. 9, subpixels of the same color are arranged on three adjacent horizontal lines of a pixel array in a diamond shape.

The TFTs are disposed in a zigzag shape along data lines D1 to Dm, so as to implement the DRD type pixel array. Two adjacent subpixels positioned on the left and right sides of one data line are sequentially charged to a data voltage from the one data line and share the one data line with each other. The output channels of the source driver ICs of the data driver 12 are respectively connected to the data lines D1 to Dm.

The source driver ICs invert a horizontal polarity pattern in a cycle of four output channels. For example, during the N-th frame period, a horizontal polarity pattern of the data voltages output through the (8i+1)-th to (8i+4)-th output channels of the source driver ICs is represented by "+−+−", and a horizontal polarity pattern of the data voltages output through the (8i+5)-th to (8i+8)-th output channels of the source driver ICs is represented by "−+−+". During the (N+1)-th frame period, a horizontal polarity pattern of the data voltages output through the (8i+1)-th to (8i+4)-th output channels of the source driver ICs is represented by "−+−+", and a horizontal polarity pattern of the data voltages output through the (8i+5)-th to (8i+8)-th output channels of the source driver ICs is represented by "+−+−". Thus, a polarity pattern of a second pixel group H4CH2 is an inverse polarity pattern of a polarity pattern of a first pixel group H4CH1. The TFTs of the first pixel group H4CH1 and the TFTs of the second pixel group H4CH2 are disposed in a left-right symmetrical manner based on a boundary between the first and second pixel groups H4CH1 and H4CH2.

In each source driver IC, the data voltages of the same polarity, which will be charged to two adjacent subpixels positioned on the left and right sides of one data line, are successively output in one horizontal period 1H. The data voltages of the same polarity are sequentially supplied to the two adjacent subpixels through the one data line in one horizontal period 1H. Thus, each of the source driver ICs of the data driver 12 inverts the polarities of the data voltages in a horizontal 1-dot and vertical 2-dot inversion scheme.

When the source driver ICs supply the data voltages, of which the polarities are inverted in the horizontal 1-dot and vertical 2-dot inversion scheme, to the data lines, a polarity pattern of the pixel array follows a horizontal 2-dot and vertical 2-dot inversion scheme due to the structure of the DRD type pixel array.

In the odd-numbered horizontal lines of the pixel array, the (4i+1)-th subpixels have the first color R; the (4i+2)-th subpixels have the second color G; the (4i+3)-th subpixels have the third color B; and the (4i+4)-th subpixels have the fourth color W.

In the even-numbered horizontal lines of the pixel array, the (4i+1)-th subpixels have the third color B; the (4i+2)-th subpixels have the fourth color W; the (4i+3)-th subpixels have the first color R; and the (4i+4)-th subpixels have the second color G.

The connection between the subpixels and the data lines shown in FIG. 9 is described below in terms of the TFTs. In the following description, a +R (or +G, +B, or +W) data voltage represents a positive R (or G, B, or W) data voltage, and a −R (or −G, −B, or −W) data voltage represents a negative R (or G, B, or W) data voltage. In FIG. 9, T11 to T18 respectively denote eight TFTs disposed on one of the odd-numbered horizontal lines of the pixel array from left to right in order. Further, T21 to T28 respectively denote eight TFTs disposed on one of the even-numbered horizontal lines of the pixel array from left to right in order.

During the N-th frame period, the source driver ICs output the positive data voltage to the data lines D1, D3, and D5, respectively, through the odd-numbered output channels and output the negative data voltage to the data lines D2, D4, and D6, respectively, through the even-numbered output channels. The data voltages output through the (8i+1)-th, (8i+4)-th, (8i+6)-th, and (8i+7)-th output channels of the source driver ICs are sequentially charged first to the left subpixel (i.e., the subpixel disposed to the left of the data line) and then to the right subpixel (i.e., the subpixel disposed to the right of the data line) as indicated by the first arrow of FIG. 9. On the other hand, the data voltages output through the (8i+2)-th, (8i+3)-th, (8i+5)-th, and (8i+8)-th output channels of the source driver ICs are sequentially charged to the right subpixel and then the left subpixel as indicated by the second and third arrows of FIG. 9. The gate driver 14 sequentially outputs the gate pulse synchronized with the data voltage.

In the odd-numbered horizontal line of the pixel array, the first TFT T11 supplies the +R data voltage supplied through the first data line D1 to the first subpixel in response to the first gate pulse from the first gate line G1. The second TFT T12 supplies the +G data voltage supplied through the first data line D1 to the second subpixel in response to the second gate pulse from the second gate line G2. The first subpixel is charged to the +R data voltage during the first half of an odd-numbered horizontal period. Subsequently, the second subpixel is charged to the +G data voltage during the second half of the odd-numbered horizontal period. The third TFT T13 supplies the −B data voltage supplied through the second data line D2 to the third subpixel in response to the second gate pulse. The fourth TFT T14 supplies the −W data voltage supplied through the second data line D2 to the fourth subpixel in response to the first gate pulse. The fourth subpixel is charged to the −W data voltage during the first half of the odd-numbered horizontal period. Subsequently, the third subpixel is charged to the −B data voltage during the second half of the odd-numbered horizontal period. The fifth TFT T15 supplies the +R data voltage supplied through the third data line D3 to the fifth subpixel in response to the second gate pulse. The sixth TFT T16 supplies the +G data voltage supplied through the third data line D3 to the sixth subpixel in response to the first gate pulse. The sixth subpixel is charged to the +G data voltage during the first half of the odd-numbered horizontal period. Subsequently, the fifth subpixel is charged to the +R data voltage during the second half of the odd-numbered horizontal period. The seventh TFT T17 supplies the −B data voltage supplied through the fourth data line D4 to the seventh subpixel in response to the first gate pulse. The eighth TFT T18 supplies the −W data voltage supplied through the fourth data line D4 to the eighth subpixel in response to the second gate pulse. The seventh subpixel is charged to the −B data voltage during the first half of the odd-numbered horizontal period. Subsequently, the eighth subpixel is charged to the −W data voltage during the second half of the odd-numbered horizontal period.

In the even-numbered horizontal line of the pixel array, the first TFT T21 supplies the −B data voltage supplied through the first data line D1 to the first subpixel in response the a third gate pulse from the third gate line G3. The second TFT T22 supplies the −W data voltage supplied through the first data line D1 to the second subpixel in response to the fourth gate pulse from the fourth gate line G4. The first subpixel is charged to the −B data voltage during the first half of an even-numbered horizontal period. Subsequently, the second subpixel is charged to the −W data voltage during the second half of the even-numbered horizontal period. The third TFT T23 supplies the +R data voltage supplied through the second data line D2 to the third subpixel in response to the fourth gate pulse. The fourth TFT T24 supplies the +G data voltage supplied through the second data line D2 to the fourth subpixel in response to the third gate pulse. The fourth subpixel is charged to the +G data voltage during the first half of the even-numbered horizontal period. Subsequently, the third subpixel is charged to the +R data voltage during the second half of the even-numbered horizontal period. The fifth TFT T25 supplies the −B data voltage supplied through the third data line D3 to the fifth subpixel in response to the fourth gate pulse. The sixth TFT T26 supplies the −W data voltage supplied through the third data line D3 to the sixth subpixel in response to the third gate pulse. The sixth subpixel is charged to the −W data voltage during the first half of the even-numbered horizontal period. Subsequently, the fifth subpixel is charged to the −B data voltage during the second half of the even-numbered horizontal period. The seventh TFT T27 supplies the +R data voltage supplied through the fourth data line D4 to the seventh subpixel in response to the third gate pulse. The eighth TFT T28 supplies the +G data voltage supplied through the fourth data line D4 to the eighth subpixel in response to the fourth gate pulse. The seventh subpixel is charged to the +R data voltage during the first half of the even-numbered horizontal period. Subsequently, the eighth subpixel is charged to the +G data voltage during the second half of the even-numbered horizontal period.

Figure 10:
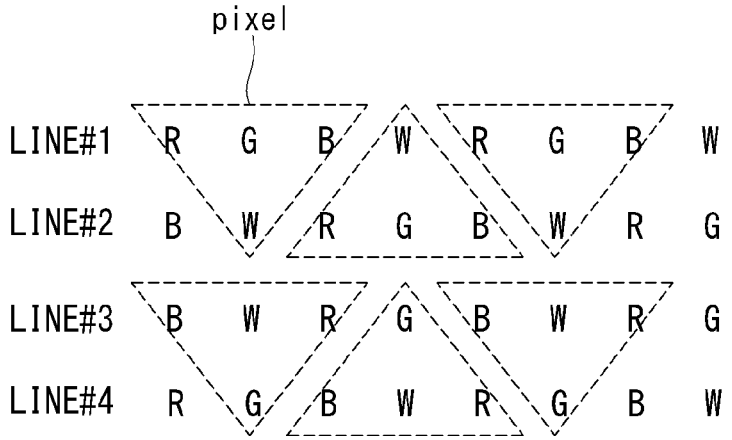
FIGS. 10 and 11 illustrate arrangements of subpixels in each pixel according to example embodiments of the invention.
Figure 11:
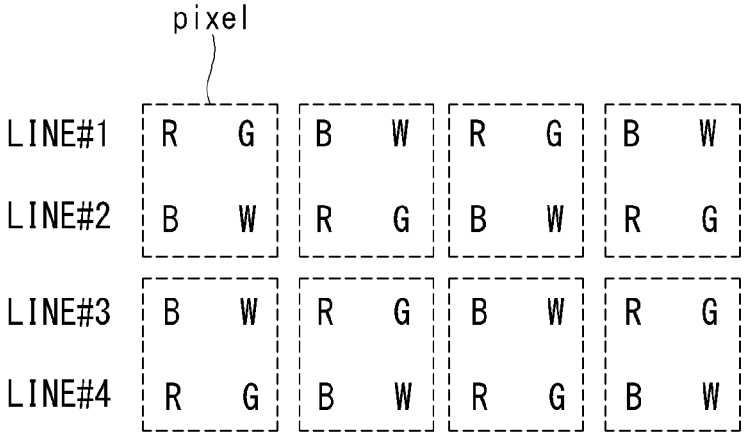

Each pixel is divided into subpixels of four colors. As shown in FIGS. 10 and 11, each of odd-numbered pixels may include RGBW subpixels disposed in a triangular or rectangular shape on adjacent odd-numbered horizontal lines LINE#1 and LINE#3 and even-numbered horizontal lines LINE#2 and LINE#4, so as to dispose the pixels without decreasing the horizontal resolution.

Figure 12:
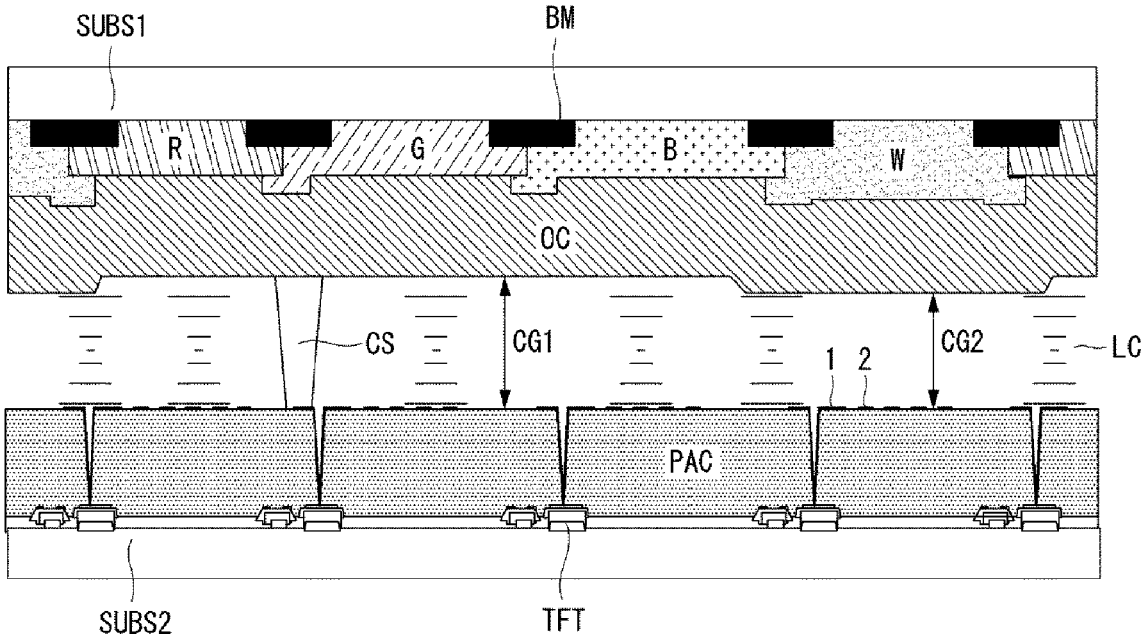
FIG. 12 illustrates a color filter of a display device according to an example embodiment of the invention.

As shown in FIG. 12, the RGBW subpixels include color filters CF formed on an upper substrate SUBS1. The RGB color filters may be formed of an acrylic resin, to which a pigment is added. The W color filter may be formed of an acrylic resin not containing a pigment and may be thicker than the other color filters. In this instance, there is a difference between a cell gap CG1 of the RGB subpixels and a cell gap CG2 of the W subpixel.

A phase retardation of liquid crystal molecules between the RGB subpixels and the W subpixel may vary due to the difference between the cell gaps CG1 and CG2. Hence, the light intensity of the W subpixel may vary, compared to the RGB subpixels. The embodiments of the present invention may prevent the W subpixels from being displayed more prominently than the RGB subpixels by arranging the W subpixels in a hexagonal or diamond shape, instead of a line shape.

In FIG. 12, "BM" denotes a black matrix, "CS" denotes a column spacer, and "PAC (photo-acryl)" denotes an organic protective layer covering a TFT array formed on a lower substrate SUBS2.

As described above, the example embodiments of the present invention arrange the RGBW subpixels in a hexagonal or diamond shape based on the same color. As a result, the present invention may achieve an excellent display image quality by reducing such undesirable effects as a flicker, line noise and color distortion, in the RGBW type display device.

It will be apparent to those skilled in the art that various modifications and variations can be made in the display device of the present invention without departing from the spirit or scope of the invention. Thus, it is intended that the present invention cover the modifications and variations of this invention provided they come within the scope of the appended claims and their equivalents.

What is claimed is:

1. A display device comprising:

a display panel including a plurality of data lines and a plurality of gate lines intersecting the data lines, and a pixel array comprising a plurality of pixels arranged in a matrix form, each pixel being divided into a subpixel having a first color, a subpixel having a second color, a subpixel having a third color, and a subpixel having a fourth color, wherein two adjacent subpixels in a horizontal line of the pixel array share one of the data lines;

a data driver configured to supply data voltages to the data lines;

a gate driver configured to sequentially supply a gate pulse to the gate lines; and a timing controller configured to transmit data of an input image to the data driver and to control the data driver and the gate driver, wherein subpixels having the first color are arranged in a hexagonal shape on four adjacent horizontal lines of the pixel array, wherein subpixels having the second color are arranged in a hexagonal shape on four adjacent horizontal lines of the pixel array, and wherein the first, second, third, and fourth colors are different colors from one another.

2. The display device of claim 1, wherein, in at least one of (4i+1)-th and (4i+4)-th horizontal lines of the pixel array, (4i+1)-th subpixels have the first color, (4i+2)-th subpixels have the second color, (4i+3)-th subpixels have the third color, and (4i+4)-th subpixels have the fourth color, where 'i' is zero or a positive integer, and wherein, in at least one of (4i+2)-th and (4i+3)-th horizontal lines of the pixel array, (4i+1)-th subpixels have the third color, (4i+2)-th subpixels have the fourth color, (4i+3)-th subpixels have the first color, and (4i+4)-th subpixels have the second color.

3. The display device of claim 2, wherein the data driver is configured to output the data voltages of a first polarity to (8i+1)-th, (8i+3)-th, (8i+6)-th, and (8i+8)-th data lines through (8i+1)-th, (8i+3)-th, (8i+6)-th, and (8i+8)-th output channels, respectively, and to output the data voltages of a second polarity to (8i+2)-th, (8i+4)-th, (8i+5)-th, and (8i+7)-th data lines through (8i+2)-th, (8i+4)-th, (8i+5)-th, and (8i+7)-th output channels, respectively, wherein the data voltage from at least one of the data lines is configured to be sequentially charged first to a subpixel on the left of the data line and then to a subpixel on the right of the data line for at least one of the horizontal lines of the pixel array, and wherein the data driver is configured to invert the polarity of the data voltages in a cycle of one horizontal period.

4. The display device of claim 3, wherein at least one of the (4i+1)-th and (4i+4)-th horizontal lines of the pixel array includes:

a first TFT configured to supply a first data voltage of the first polarity and the first color from a k-th data line to a first subpixel in response to a j-th gate pulse from a j-th gate line, where 'j' and 'k' are each a positive integer;

a second TFT configured to supply a first data voltage of the first polarity and the second color from the k-th data line to a second subpixel in response to a (j+1)-th gate pulse from a (j+1)-th gate line;

a third TFT configured to supply a first data voltage of the second polarity and the third color from a (k+1)-th data line to a third subpixel in response to the j-th gate pulse;

a fourth TFT configured to supply a first data voltage of the second polarity and the fourth color from the (k+1)-th data line to a fourth subpixel in response to the (j+1)-th gate pulse;

a fifth TFT configured to supply a second data voltage of the first polarity and the first color from a (k+2)-th data line to a fifth subpixel in response to the j-th gate pulse;

a sixth TFT configured to supply a second data voltage of the first polarity and the second color from the (k+2)-th data line to a sixth subpixel in response to the (j+1)-th gate pulse;

a seventh TFT configured to supply a second data voltage of the second polarity and the third color from a (k+3)-th data line to a seventh subpixel in response to the j-th gate pulse; and an eighth TFT configured to supply a second data voltage of the second polarity and the fourth color from the (k+3)-th data line to an eighth subpixel in response to the (j+1)-th gate pulse.

5. The display device of claim 4, wherein at least one of the (4i+2)-th and (4i+3)-th horizontal lines of the display panel includes:

a ninth TFT configured to supply a third data voltage of the second polarity and the third color from the k-th data line to a ninth subpixel in response to a (j+2)-th gate pulse from a (j+2)-th gate line;

a tenth TFT configured to supply a third data voltage of the second polarity and the fourth color from the k-th data line to a tenth subpixel in response to a (j+3)-th gate pulse from a (j+3)-th gate line;

an eleventh TFT configured to supply a third data voltage of the first polarity and the first color from the (k+1)-th data line to an eleventh subpixel in response to the (j+2)-th gate pulse;

a twelfth TFT configured to supply a third data voltage of the first polarity and the third color from the (k+1)-th data line to a twelfth subpixel in response to the (j+3)-th gate pulse;

a thirteenth TFT configured to supply a fourth data voltage of the second polarity and third color from the (k+2)-th data line to a thirteenth subpixel in response to the (j+2)-th gate pulse;

a fourteenth TFT configured to supply a fourth data voltage of the second polarity and the fourth color from the (k+2)-th data line to a fourteenth subpixel in response to the (j+3)-th gate pulse;

a fifteenth TFT configured to supply a fourth data voltage of the first polarity and the first color from the (k+3)-th data line to a fifteenth subpixel in response to the (j+2)-th gate pulse; and a sixteenth TFT configured to supply a fourth data voltage of the first polarity and the second color from the (k+3)-th data line to an sixteenth subpixel in response to the (j+3)-th gate pulse.

6. The display device of claim 2, wherein the data driver is configured to output the data voltages of a first polarity to (4i+1)-th and (4i+2)-th data lines through (4i+1)-th and (4i+2)-th output channels, respectively, and to output the data voltages of a second polarity to (4i+3)-th and (4i+4)-th data lines through (4i+3)-th and (4i+4)-th output channels, respectively, wherein the data voltage from at least one of the data lines is sequentially charged first to a subpixel on the left of the data line and then to a subpixel on the right of the data line for at least one of the horizontal lines of the pixel array, and wherein the data driver is configured to invert the polarity of the data voltages in a cycle of one horizontal period.

7. The display device of claim 6, wherein at least one of the (4i+1)-th and (4i+4)-th horizontal lines of the pixel array includes:

a first TFT configured to supply a first data voltage of the first polarity and the first color from a k-th data line to a first subpixel in response to a j-th gate pulse from a j-th gate line, where 'j' and 'k' are each a positive integer;

a second TFT configured to supply a first data voltage of the first polarity and the second color from the k-th data line to a second subpixel in response to a (j+1)-th gate pulse from a (j+1)-th gate line;

a third TFT configured to supply a first data voltage of the first polarity and the third color from a (k+1)-th data line to a third subpixel in response to the j-th gate pulse;

a fourth TFT configured to supply a first data voltage of the first polarity and the fourth color from the (k+1)-th data line to a fourth subpixel in response to the (j+1)-th gate pulse;

a fifth TFT configured to supply a first data voltage of the second polarity and the first color from a (k+2)-th data line to a fifth subpixel in response to the j-th gate pulse;

a sixth TFT configured to supply a first data voltage of the second polarity and the second color from the (k+2)-th data line to a sixth subpixel in response to the (j+1)-th gate pulse;

a seventh TFT configured to supply a first data voltage of the second polarity and the third color from a (k+3)-th data line to a seventh subpixel in response to the j-th gate pulse; and an eighth TFT configured to supply a first data voltage of the second polarity and the fourth color supplied through the (k+3)-th data line to an eighth subpixel in response to the (j+1)-th gate pulse.

8. The display device of claim 7, wherein at least one of the (4i+2)-th and (4i+3)-th horizontal lines of the pixel array includes:

a ninth TFT configured to supply a second data voltage of the second polarity and the third color from the k-th data line to a ninth subpixel in response to a (j+2)-th gate pulse from a (j+2)-th gate line;

a tenth TFT configured to supply a second data voltage of the second polarity and the fourth color from the k-th data line to a tenth subpixel in response to a (j+3)-th gate pulse from a (j+3)-th gate line;

an eleventh TFT configured to supply a second data voltage of the second polarity and the first color from the (k+1)-th data line to an eleventh subpixel in response to the (j+2)-th gate pulse;

a twelfth TFT configured to supply a second data voltage of the second polarity and the second color from the (k+1)-th data line to a twelfth subpixel in response to the (j+3)-th gate pulse;

a thirteenth TFT configured to supply a second data voltage of the first polarity and the third color from the (k+2)-th data line to a thirteenth subpixel in response to the (j+2)-th gate pulse;

a fourteenth TFT configured to supply a second data voltage of the first polarity and the fourth color from the (k+2)-th data line to a fourteenth subpixel in response to the (j+3)-th gate pulse;

a fifteenth TFT configured to supply a second data voltage of the first polarity and the first color from the (k+3)-th data line to a fifteenth subpixel in response to the (j+2)-th gate pulse; and a sixteenth TFT configured to supply a second data voltage of the first polarity and the second color from the (k+3)-th data line to a sixteenth subpixel in response to the (j+3)-th gate pulse.

9. A display device of claim 1, wherein the four subpixels of each of the pixels are disposed in two adjacent horizontal lines of the pixel array, either with three of the four subpixels disposed in one of the two adjacent horizontal lines and the other subpixel in the other of the two adjacent horizontal lines, or with two of the subpixels disposed in each of the two adjacent horizontal lines.

10. The display device of claim 1, wherein subpixels having the third color are arranged in a hexagonal shape on four adjacent horizontal lines of the pixel array, and wherein subpixels having the fourth color are arranged in a hexagonal shape on four adjacent horizontal lines of the pixel array.

11. A display device comprising:

a display panel including a plurality of data lines and a plurality of gate lines intersecting the data lines, and a pixel array comprising a plurality of pixels arranged in a matrix form, each pixel being divided into a subpixel having a first color, a subpixel having a second color, a subpixel having a third color, and a subpixel having a fourth color, wherein two adjacent subpixels in a horizontal line of the pixel array share one of the data lines;

a data driver configured to supply data voltages to the data lines, wherein the data driver is configured to supply, in one horizontal period, data voltages of a same polarity to the two adjacent subpixels in a horizontal line of the pixel array sharing one of the data lines;

a gate driver configured to sequentially supply a gate pulse to the gate lines; and a timing controller configured to transmit data of an input image to the data driver and to control the data driver and the gate driver, wherein subpixels having the first color are arranged in a diamond shape on three adjacent horizontal lines of the pixel array, wherein subpixels having the second color are arranged in a diamond shape on three adjacent horizontal lines of the pixel array, and wherein the first, second, third, and fourth colors are different colors from one another.

12. The display device of claim 11, wherein, in at least one of odd-numbered horizontal lines of the pixel array, (4i+1)-th subpixels have the first color, (4i+2)-th subpixels have the second color, (4i+3)-th subpixels have the third color, and (4i+4)-th subpixels have the fourth color, where 'i' is zero or a positive integer, and wherein, in at least one of even-numbered horizontal lines of the pixel array, (4i+1)-th subpixels have the third color, (4i+2)-th subpixels have the fourth color, (4i+3)-th subpixels have the first color, and (4i+4)-th subpixels have the second color.

13. The display device of claim 12, wherein the data driver is configured to output the data voltages of a first polarity to odd-numbered data lines through odd-numbered output channels, respectively, and to output the data voltages of a second polarity to even-numbered data lines through even-numbered output channels, respectively, wherein the data voltage from at least one of the odd-numbered data lines is configured to be sequentially charged first to a subpixel on the left of the odd-numbered data line and then to a subpixel on the right of the data line for at least one of the horizontal lines of the pixel array, and wherein the data driver is configured to invert the polarity of the data voltages in a cycle of one horizontal period.

14. The display device of claim 13, wherein at least one of the odd numbered horizontal lines of the pixel array includes:

a first TFT configured to supply a first data voltage of the first polarity and the first color from a k-th data line to a first subpixel in response to a j-th gate pulse from a j-th gate line, where 'j' and 'k' are each a positive integer;

a second TFT configured to supply a first data voltage of the first polarity and the second color from the k-th data line to a second subpixel in response to a (j+1)-th gate pulse from a (j+1)-th gate line;

a third TFT configured to supply a first data voltage of the second polarity and the third color from a (k+1)-th data line to a third subpixel in response to the j-th gate pulse;

a fourth TFT configured to supply a first data voltage of the second polarity and the fourth color from the (k+1)-th data line to a fourth subpixel in response to the (j+1)-th gate pulse;

a fifth TFT configured to supply a second data voltage of the first polarity and the first color from a (k+2)-th data line to a fifth subpixel in response to the j-th gate pulse;

a sixth TFT configured to supply a second data voltage of the first polarity and the second color from the (k+2)-th data line to a sixth subpixel in response to the (j+1)-th gate pulse;

a seventh TFT configured to supply a second data voltage of the second polarity and the third color from a (k+3)-th data line to a seventh subpixel in response to the j-th gate pulse; and an eighth TFT configured to supply a second data voltage of the second polarity and the fourth color from the (k+3)-th data line to an eighth subpixel in response to the (j+1)-th gate pulse.

15. The display device of claim 14, wherein at least one of the even-numbered horizontal lines of the display panel includes:

a ninth TFT configured to supply a third data voltage of the second polarity and the third color from the k-th data line to a ninth subpixel in response to a (j+2)-th gate pulse from a (j+2)-th gate line;

a tenth TFT configured to supply a third data voltage of the second polarity and the fourth color from the k-th data line to a tenth subpixel in response to a (j+3)-th gate pulse from a (j+3)-th gate line;

an eleventh TFT configured to supply a third data voltage of the first polarity and the first color from the (k+1)-th data line to an eleventh subpixel in response to the (j+2)-th gate pulse;

a twelfth TFT configured to supply a third data voltage of the first polarity and the third color from the (k+1)-th data line to a twelfth subpixel in response to the (j+3)-th gate pulse;

a thirteenth TFT configured to supply a fourth data voltage of the second polarity and third color from the (k+2)-th data line to a thirteenth subpixel in response to the (j+2)-th gate pulse;

a fourteenth TFT configured to supply a fourth data voltage of the second polarity and the fourth color from the (k+2)-th data line to a fourteenth subpixel in response to the (j+3)-th gate pulse;

a fifteenth TFT configured to supply a fourth data voltage of the first polarity and the first color from the (k+3)-th data line to a fifteenth subpixel in response to the (j+2)-th gate pulse; and a sixteenth TFT configured to supply a fourth data voltage of the first polarity and the second color from the (k+3)-th data line to an sixteenth subpixel in response to the (j+3)-th gate pulse.

16. The display device of claim 13, wherein the data voltage from at least one of the even-numbered data lines is configured to be sequentially charged first to a subpixel on the right of the even-numbered data line and then to a subpixel on the left of the even-numbered data line for the at least one of the horizontal lines of the pixel array.

17. The display device of claim 12, wherein the data driver is configured to output the data voltages of a first polarity to (4i+1)-th and (4i+2)-th data lines through (4i+1)-th and (4i+2)-th output channels, respectively, and to output the data voltages of a second polarity to (4i+3)-th and (4i+4)-th data lines through (4i+3)-th and (4i+4)-th output channels, respectively, wherein the data voltage from at least one of the data lines is sequentially charged first to a subpixel on the left of the data line and then to a subpixel on the right of the data line for at least one of the horizontal lines of the pixel array, and wherein the data driver is configured to invert the polarity of the data voltages in a cycle of one horizontal period.

18. The display device of claim 17, wherein at least one of the odd-numbered horizontal lines of the pixel array includes:

a first TFT configured to supply a first data voltage of the first polarity and the first color from a k-th data line to a first subpixel in response to a j-th gate pulse from a j-th gate line, where 'j' and 'k' are each a positive integer;

a second TFT configured to supply a first data voltage of the first polarity and the second color from the k-th data line to a second subpixel in response to a (j+1)-th gate pulse from a (j+1)-th gate line;

a third TFT configured to supply a first data voltage of the first polarity and the third color from a (k+1)-th data line to a third subpixel in response to the j-th gate pulse;

a fourth TFT configured to supply a first data voltage of the first polarity and the fourth color from the (k+1)-th data line to a fourth subpixel in response to the (j+1)-th gate pulse;

a fifth TFT configured to supply a first data voltage of the second polarity and the first color from a (k+2)-th data line to a fifth subpixel in response to the j-th gate pulse;

a sixth TFT configured to supply a first data voltage of the second polarity and the second color from the (k+2)-th data line to a sixth subpixel in response to the (j+1)-th gate pulse;

a seventh TFT configured to supply a first data voltage of the second polarity and the third color from a (k+3)-th data line to a seventh subpixel in response to the j-th gate pulse; and an eighth TFT configured to supply a first data voltage of the second polarity and the fourth color supplied through the (k+3)-th data line to an eighth subpixel in response to the (j+1)-th gate pulse.

19. The display device of claim 18, wherein at least one of the even-numbered horizontal lines of the pixel array includes:

a ninth TFT configured to supply a second data voltage of the second polarity and the third color from the k-th data line to a ninth subpixel in response to a (j+2)-th gate pulse from a (j+2)-th gate line;

a tenth TFT configured to supply a second data voltage of the second polarity and the fourth color from the k-th data line to a tenth subpixel in response to a (j+3)-th gate pulse from a (j+3)-th gate line;

an eleventh TFT configured to supply a second data voltage of the second polarity and the first color from the (k+1)-th data line to an eleventh subpixel in response to the (j+2)-th gate pulse;

a twelfth TFT configured to supply a second data voltage of the second polarity and the second color from the (k+1)-th data line to a twelfth subpixel in response to the (j+3)-th gate pulse;

a thirteenth TFT configured to supply a second data voltage of the first polarity and the third color from the (k+2)-th data line to a thirteenth subpixel in response to the (j+2)-th gate pulse;

a fourteenth TFT configured to supply a second data voltage of the first polarity and the fourth color from the (k+2)-th data line to a fourteenth subpixel in response to the (j+3)-th gate pulse;

a fifteenth TFT configured to supply a second data voltage of the first polarity and the first color from the (k+3)-th data line to a fifteenth subpixel in response to the (j+2)-th gate pulse; and a sixteenth TFT configured to supply a second data voltage of the first polarity and the second color from the (k+3)-th data line to a sixteenth subpixel in response to the (j+3)-th gate pulse.

20. The display device of claim 12, wherein the data driver is configured to output the data voltages of a first polarity to (8i+1)-th, (8i+3)-th, (8i+6)-th, and (8i+8)-th data lines through (8i+1)-th, (8i+3)-th, (8i+6)-th, and (8i+8)-th output channels, respectively, and to output the data voltages of a second polarity to (8i+2)-th, (8i+4)-th, (8i+5)-th, and (8i+7)-th data lines through (8i+2)-th, (8i+4)-th, (8i+5)-th, and (8i+7)-th output channels, respectively, wherein the data voltage from at least one of the (8i+1)-th, (8i+4)-th, (8i+6)-th, and (8i+7)-th data lines is configured to be sequentially charged first to a subpixel on the left of the data line and then to a subpixel on the right of the data line for at least one of the horizontal lines of the pixel array, wherein the data voltage from at least one of the (8i+2)-th, (8i+3)-th, (8i+5)-th, and (8i+8)-th data lines is configured to be sequentially charged first to a subpixel on the right of the even-numbered data line and then to a subpixel on the left of the even-numbered data line for the at least one of the horizontal lines of the pixel array; and wherein the data driver is configured to invert the polarity of the data voltages in a cycle of one horizontal period.

21. The display device of claim 20, wherein at least one of the odd-numbered horizontal lines of the pixel array includes:

a first TFT configured to supply a first data voltage of the first polarity and the first color from a k-th data line to a first subpixel in response to a j-th gate pulse from a j-th gate line, where 'j' and 'k' are each a positive integer;

a second TFT configured to supply a first data voltage of the first polarity and the second color from the k-th data line to a second subpixel in response to a (j+1)-th gate pulse from a (j+1)-th gate line;

a third TFT configured to supply a first data voltage of the second polarity and the third color from a (k+1)-th data line to a third subpixel in response to the j-th gate pulse;

a fourth TFT configured to supply a first data voltage of the second polarity and the fourth color from the (k+1)-th data line to a fourth subpixel in response to the (j+1)-th gate pulse;

a fifth TFT configured to supply a second data voltage of the first polarity and the first color from a (k+2)-th data line to a fifth subpixel in response to the j-th gate pulse;

a sixth TFT configured to supply a second data voltage of the first polarity and the second color from the (k+2)-th data line to a sixth subpixel in response to the (j+1)-th gate pulse;

a seventh TFT configured to supply a second data voltage of the second polarity and the third color from a (k+3)-th data line to a seventh subpixel in response to the j-th gate pulse; and an eighth TFT configured to supply a second data voltage of the second polarity and the fourth color from the (k+3)-th data line to an eighth subpixel in response to the (j+1)-th gate pulse.

22. The display device of claim 21, wherein at least one of the even-numbered horizontal lines of the display panel includes:

a ninth TFT configured to supply a third data voltage of the second polarity and the third color from the k-th data line to a ninth subpixel in response to a (j+2)-th gate pulse from a (j+2)-th gate line;

a tenth TFT configured to supply a third data voltage of the second polarity and the fourth color from the k-th data line to a tenth subpixel in response to a (j+3)-th gate pulse from a (j+3)-th gate line;

an eleventh TFT configured to supply a third data voltage of the first polarity and the first color from the (k+1)-th data line to an eleventh subpixel in response to the (j+2)-th gate pulse;

a twelfth TFT configured to supply a third data voltage of the first polarity and the third color from the (k+1)-th data line to a twelfth subpixel in response to the (j+3)-th gate pulse;

a thirteenth TFT configured to supply a fourth data voltage of the second polarity and third color from the (k+2)-th data line to a thirteenth subpixel in response to the (j+2)-th gate pulse;

a fourteenth TFT configured to supply a fourth data voltage of the second polarity and the fourth color from the (k+2)-th data line to a fourteenth subpixel in response to the (j+3)-th gate pulse;

a fifteenth TFT configured to supply a fourth data voltage of the first polarity and the first color from the (k+3)-th data line to a fifteenth subpixel in response to the (j+2)-th gate pulse; and a sixteenth TFT configured to supply a fourth data voltage of the first polarity and the second color from the (k+3)-th data line to an sixteenth subpixel in response to the (j+3)-th gate pulse.

23. The display device of claim 11, wherein each of the pixels is divided into no more than four subpixels consisting of a subpixel having the first color, a subpixel having the second color, a subpixel having the third color, and a subpixel having the fourth color.

24. The display device of claim 23, wherein the four subpixels of each of the pixels are disposed in two adjacent horizontal lines of the pixel array, either with three of the four subpixels disposed in one of the two adjacent horizontal lines and the other subpixel in the other of the two adjacent horizontal lines, or with two of the subpixels disposed in each of the two adjacent horizontal lines.

25. A display device comprising:

a display panel including a plurality of data lines and a plurality of gate lines intersecting the data lines, and a pixel array comprising a plurality of pixels arranged in a matrix form, each pixel being divided into no more than four subpixels consisting of a subpixel having a first color, a subpixel having a second color, a subpixel having a third color, and a subpixel having a fourth color, the first, second, third, and fourth colors being different colors from one another;

a data driver configured to supply data voltages to the data lines;

a gate driver configured to sequentially supply a gate pulse to the gate lines; and a timing controller configured to transmit data of an input image to the data driver and to control the data driver and the gate driver, wherein the four subpixels of each of the pixels are disposed in two adjacent horizontal lines of the pixel array, with three of the four subpixels disposed in one of the two adjacent horizontal lines and the other subpixel in the other of the two adjacent horizontal lines.

26. The display device of claim 25, wherein, in one of the pixels, three subpixels respectively having three of the four colors are disposed in the one of the two adjacent horizontal lines, and the other subpixel having the other of the four colors is disposed in the other of the two adjacent horizontal lines, and wherein, in a pixel adjacent to the one of the pixels, a subpixel having the other of the four colors is disposed in the one of the two adjacent horizontal lines, and the other three subpixels having the three of the four colors are disposed in the other of the two adjacent horizontal lines.

* * * * *